US012134737B1

(12) United States Patent
Koseoglu

(10) Patent No.: US 12,134,737 B1
(45) Date of Patent: Nov. 5, 2024

(54) FLUID CATALYTIC CRACKING UNIT WITH REACTIVITY BASED NAPHTHA RECYCLE TO ENHANCE PROPYLENE PRODUCTION

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/303,998

(22) Filed: Apr. 20, 2023

(51) Int. Cl.
*C10G 11/00* (2006.01)
*C10G 11/18* (2006.01)

(52) U.S. Cl.
CPC .... *C10G 11/187* (2013.01); *C10G 2300/1059* (2013.01); *C10G 2300/107* (2013.01); *C10G 2300/1074* (2013.01); *C10G 2300/4018* (2013.01); *C10G 2300/4081* (2013.01); *C10G 2400/20* (2013.01)

(58) Field of Classification Search
CPC ..... C10G 11/187; C10G 2300/1059; C10G 2300/107; C10G 2300/1074; C10G 2300/4018; C10G 2300/4081; C10G 2400/20
See application file for complete search history.

(56) References Cited

U.S. PATENT DOCUMENTS 3,074,878 A 1/1963 Pappas
4,419,221 A 12/1983 Castagnos, Jr. et al.
5,462,652 A 10/1995 Wegerer
6,069,287 A 5/2000 Ladwig et al.
6,093,867 A 7/2000 Ladwig et al.
6,106,697 A 8/2000 Swan et al.
6,118,035 A 9/2000 Fung et al.
6,258,257 B1 7/2001 Swan, III et al.
6,258,990 B1 7/2001 Fung et al.
6,313,366 B1 11/2001 Ladwig et al.
6,315,890 B1 11/2001 Ladwig et al.
6,339,180 B1 1/2002 Ladwig et al.
6,339,181 B1 1/2002 Chen et al.
6,338,152 B1 5/2002 Ladwig et al.
(Continued)

OTHER PUBLICATIONS

Abbot et al., "Catalytic Cracking of Linear Paraffins: Effects of Chain Length", Ind. Eng. Chem. Res., vol. 36, pp. 76-82, 1997.
(Continued)

*Primary Examiner* — Ellen M McAvoy
*Assistant Examiner* — Chantel Graham
(74) *Attorney, Agent, or Firm* — Dinsmore & Shohl LLP

(57) ABSTRACT

A process comprises contacting a hydrocarbon feed with an FCC catalyst in an FCC reactor at reaction conditions that cause at least a portion of hydrocarbons from the hydrocarbon feed to undergo catalytic cracking reactions to a cracking effluent comprising the light olefins separating the cracking effluent in a cracking effluent separation system to produce a light olefin effluent and a plurality of FCC naphtha fractions, recycling at least two of the plurality of FCC naphtha fractions back to the FCC reactor, and injecting each of the at least two of the plurality of FCC naphtha fractions at a different location within the FCC reactor based on reactivity of each of the at least two of the plurality of FCC naphtha.

20 Claims, 5 Drawing Sheets

(56) References Cited

U.S. PATENT DOCUMENTS

| | | | | |
|---|---|---|---|---|
| 6,803,494 | B1 | 10/2004 | Ladwig et al. | |
| 7,323,099 | B2 | 1/2008 | Henry | |
| 7,374,660 | B2 | 5/2008 | Steffens et al. | |
| 10,758,883 | B2 | 9/2020 | Chen et al. | |
| 11,161,086 | B2 | 11/2021 | Chen et al. | |
| 11,319,262 | B2 | 5/2022 | Wu et al. | |
| 11,377,602 | B2 | 7/2022 | Tomsula et al. | |
| 11,629,298 | B2 | 4/2023 | Koseoglu | |
| 2004/0258580 | A1* | 12/2004 | Abrevaya | C07C 4/06 422/140 |
| 2005/0150817 | A1 | 7/2005 | Tallman et al. | |
| 2006/0108260 | A1 | 5/2006 | Henry | |
| 2006/0108261 | A1 | 5/2006 | Steffens et al. | |
| 2008/0223754 | A1* | 9/2008 | Subramanian | C10G 69/04 196/14.52 |
| 2014/0275675 | A1* | 9/2014 | Eng | C10G 11/18 585/303 |
| 2020/0009523 | A1 | 1/2020 | Chen et al. | |
| 2020/0318019 | A1 | 10/2020 | Tomsula et al. | |
| 2020/0376456 | A1 | 12/2020 | Chen et al. | |
| 2021/0130262 | A1 | 5/2021 | Wu et al. | |
| 2021/0355389 | A1 | 11/2021 | Koseoglu | |
| 2022/0055005 | A1 | 2/2022 | Chen et al. | |
| 2022/0234968 | A1 | 7/2022 | Wu et al. | |

OTHER PUBLICATIONS

Ying et al., "Kinetic modeling of C2-C7 olefins interconversion over ZSM-5 catalyst", Journal of Industrial and Engineering Chemistry, vol. 33, pp. 80-90, 2016.

* cited by examiner

FLUID CATALYTIC CRACKING UNIT WITH REACTIVITY BASED NAPHTHA RECYCLE TO ENHANCE PROPYLENE PRODUCTION

TECHNICAL FIELD

The present disclosure relates to processes for processing hydrocarbon feeds to produce light olefins through fluidized catalytic cracking.

TECHNICAL BACKGROUND

Ethylene, propene, butenes, butadiene, and aromatics compounds such as benzene, toluene and xylenes are basic intermediates for a large proportion of the petrochemical industry. They are usually obtained through thermal cracking (or steam pyrolysis) of petroleum gases and distillates such as naphtha, kerosene or even gas oil. These compounds are also produced through refinery fluidized catalytic cracking (FCC) processes where classical heavy feedstocks such as gas oils or residues are converted. Typical FCC feedstocks range from hydrocracked bottoms to heavy feed fractions such as straight run vacuum gas oil and atmospheric residue; however, these feedstocks are limited. The second most important source for propene production is currently refinery propene from FCC units. The worldwide increasing demand for light olefins remains a major challenge for many integrated refineries. In particular, the production of some valuable light olefins such as ethylene, propene, and butenes has attracted increased attention as pure olefin streams are considered the building blocks for polymer synthesis.

SUMMARY

Accordingly, there is an ongoing need for processes for fluidized catalytic cracking of hydrocarbon feeds to produce greater yields of light olefins. The present disclosure is directed to processes for upgrading a hydrocarbon feed through fluidized catalytic cracking (FCC) to produce greater yields of light olefins, such as but not limited to propylene. The processes include contacting a hydrocarbon feed with an FCC catalyst in an FCC reactor, separating the cracking effluent in a cracking effluent separation system to produce a light olefin effluent and a plurality of FCC naphtha fractions, recycling at least two of FCC naphtha fractions back to the FCC reactor, and injecting each of the FCC naphtha fractions at a different location within the FCC reactor based on reactivity of each of the FCC naphtha fractions.

According one or more aspects of the present disclosure, a process for producing light olefins through fluidized catalytic cracking (FCC), the process comprising: contacting a hydrocarbon feed with an FCC catalyst in an FCC reactor at reaction conditions that cause at least a portion of hydrocarbons from the hydrocarbon feed to undergo catalytic cracking reactions to a cracking effluent comprising the light olefins, where the light olefins comprise ethylene, propylene, butenes, or combinations of these; separating the cracking effluent in a cracking effluent separation system to produce a light olefin effluent and a plurality of FCC naphtha fractions, where: the light olefin effluent comprises propylene, butenes, or combinations thereof, each of the plurality of FCC naphtha fraction has a different boiling point temperature range; and the constituents of all of the plurality of FCC naphtha fractions have a number of carbon atoms between 5 and 12; recycling at least two of the FCC naphtha fractions back to the FCC reactor; and injecting each of the FCC naphtha fractions at a different location within the FCC reactor based on reactivity of each of the at least two of the plurality of FCC naphtha.

Additional features and advantages of the described embodiments will be set forth in the detailed description which follows, and in part will be readily apparent to those skilled in the art from that description or recognized by practicing the described embodiments, including the detailed description which follows as well as the drawings and the claims.

BRIEF DESCRIPTION OF THE DRAWINGS

The following detailed description of specific aspects of the present disclosure can be best understood when read in conjunction with the following drawings, in which like structure is indicated with like reference numerals and in which.

Figure 1:
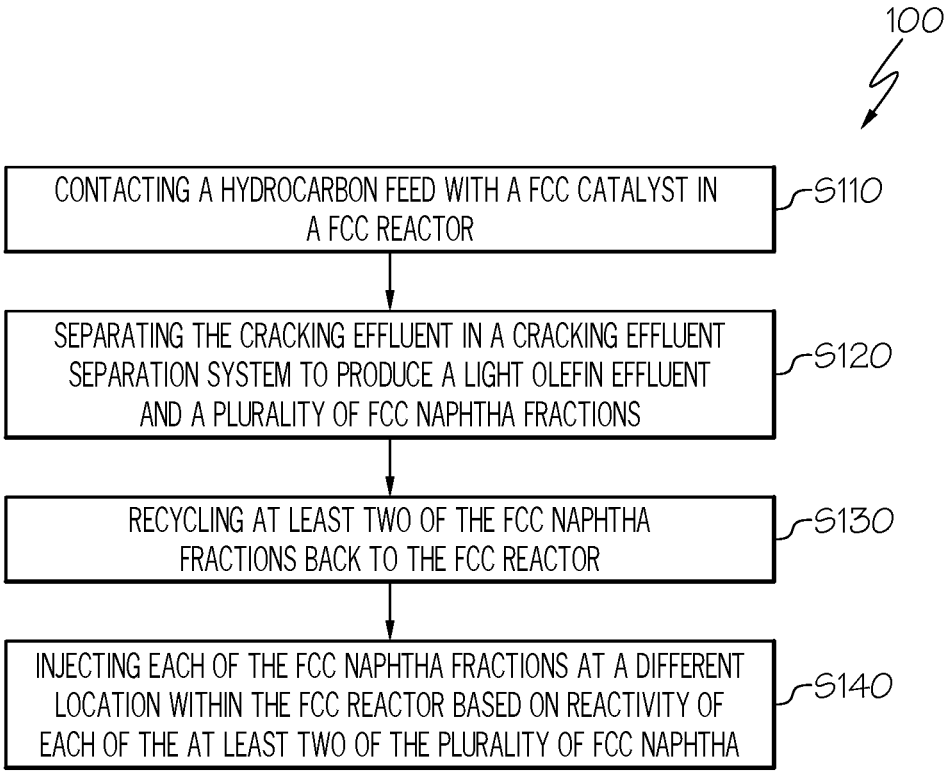
FIG. 1 depicts a flowchart of a process for processing hydrocarbon feeds to produce light olefins through fluidized catalytic cracking, according to one or more embodiments shown and described in the present disclosure.

When describing the generalized flow diagrams of the present application, the numerous valves, temperature sensors, electronic controllers, and the like, which may be used and are well known to a person of ordinary skill in the art, may not be included. Further, accompanying components that are often included in systems, such as those depicted in the generalized flow diagrams, such as but not limited to air supplies, heat exchangers, surge tanks, and the like also may not be included. However, a person of ordinary skill in the art understands that these components are within the scope of the present disclosure.

Additionally, the arrows in the generalized flow diagrams refer to process streams. However, the arrows may equivalently refer to transfer lines, which may transfer process streams between two or more system components. Arrows that connect to one or more system components signify inlets or outlets in the given system components and arrows that connect to only one system component signify a system outlet stream that exits the depicted system or a system inlet stream that enters the depicted system. The arrow direction generally corresponds with the major direction of movement of the process stream or the process stream contained within the physical transfer line signified by the arrow.

The arrows in the generalized flow diagrams may also refer to process steps of transporting a process stream from one system component to another system component. For example, an arrow from a first system component pointing to a second system component may signify "passing" a process stream from the first system component to the second system component, which may comprise the process stream "exiting" or being "removed" from the first system component and "introducing" the process stream to the second system component.

Reference will now be made in greater detail to various aspects, some of which are illustrated in the accompanying drawings.

DETAILED DESCRIPTION

The present disclosure is directed to processes for producing light olefins through fluidized catalytic cracking (FCC). The processes include contacting a hydrocarbon feed with an FCC catalyst in an FCC reactor at reaction conditions that cause at least a portion of hydrocarbons from the hydrocarbon feed to undergo catalytic cracking reactions to a cracking effluent comprising the light olefins. The light olefins may include ethylene, propylene, butenes, or combinations of these. The processes may further include separating the cracking effluent in a cracking effluent separation system to produce a light olefin effluent and a plurality of FCC naphtha fractions, recycling at least two of the plurality of FCC naphtha fractions back to the FCC reactor, and injecting each of the FCC naphtha fractions at a different location within the FCC reactor based on the reactivity of each of the FCC naphtha fractions. The light olefin effluent may include propylene, butenes, or combinations thereof. Each FCC naphtha fraction may have a different boiling point temperature range. The constituents of all of the plurality of FCC naphtha fractions may have a number of carbon atoms between 5 and 12.

As used in the present disclosure, the term "cracking" refers to a chemical reaction where a molecule having carbon-carbon bonds is broken into more than one molecule by the breaking of one or more of the carbon-carbon bonds or a cyclic molecule having carbon-carbon bonds is converted to a non-cyclic molecule by the breaking or one or more of the carbon-carbon bonds. As used in the present disclosure, the term "catalytic cracking" refers to cracking conducted in the presence of a catalyst. Some catalysts may have multiple forms of catalytic activity, and calling a catalyst by one particular function does not render that catalyst incapable of being catalytically active for other functionality.

As used in the present disclosure, the term "catalyst" refers to any substance that increases the rate of a specific chemical reaction, such as but not limited to cracking reactions.

As used in this disclosure, the term "spent catalyst" refers to a catalyst that has been introduced to and passed through a cracking reaction zone to crack a hydrocarbon material, but has not been regenerated in the regenerator or otherwise regenerated in a regeneration process following introduction to the cracking reaction zone. The "spent catalyst" may have coke deposited on the catalyst and may include partially coked catalyst as well as fully coked catalyst. The amount of coke deposited on the "spent catalyst" may be greater than the amount of coke remaining on the regenerated catalyst following regeneration.

As used in the present disclosure, the term "regenerated catalyst" refers to a catalyst that has been contacted with reactants at reaction conditions and then regenerated in a regenerator or regenerated through an in-place regeneration process to heat the catalyst to a greater temperature, oxidize and remove at least a portion of the coke or other organic contaminants from the catalyst to restore at least a portion of the catalytic activity of the catalyst, or both. The "regenerated catalyst" may have less coke or organic contaminants, greater heat content, or both, compared to a used catalyst and may have greater catalytic activity compared to the used catalyst. The "regenerated catalyst" may have more coke and reduced catalytic activity compared to a fresh catalyst that has not been contacted with reactants in a cracking reaction zone and then regenerated.

As used throughout the present disclosure, the terms "butenes" or "mixed butenes" are used interchangeably and refer to combinations of one or a plurality of isobutene, 1-butene, trans-2-butene, or cis-2-butene. As used throughout the present disclosure, the term "normal butenes" refers to a combination of one or a plurality of 1-butene, trans-2-butene, or cis-2-butene. As used throughout the present disclosure, the term "2-butenes" refers to trans-2-butene, cis-2-butene, or a combinations of these.

As used in this disclosure, the term "initial boiling point" or "IBP" of a composition refers to the temperature at which the constituents of the composition with the lowest boiling point temperatures begin to transition from the liquid phase to the vapor phase. As used in this disclosure, the term "Final Boiling Point" or "FBP" of a composition refers to the temperature at which the greatest boiling temperature constituents of the composition transition from the liquid phase to the vapor phase. A hydrocarbon mixture may be characterized by a distillation profile expressed as boiling point temperatures at which a specific weight percentages of the composition has transitioned from the liquid phase to the vapor phase.

As used in this disclosure, the term "crude oil" or "whole crude oil" is to be understood to mean a mixture of petroleum liquids, gases, or combinations of liquids and gases, including, in embodiments, impurities such as but not limited to sulfur-containing compounds, nitrogen-containing compounds, or metal compounds, that have not undergone significant separation or reaction processes. Crude oils are distinguished from fractions of crude oil, which are obtained through fractionation of the crude oil through distillation or other separation process. In embodiments, the crude oil feedstock may be a minimally treated light crude oil to provide a crude oil feedstock having total metals (Ni+V) content of less than 5 parts per million by weight (ppmw) and Conradson carbon residue of less than 5 wt. %.

As used in the present disclosure, passing a stream or effluent from one unit "directly" to another unit refers to passing the stream or effluent from the first unit to the second unit without passing the stream or effluent through an intervening reaction system or separation system that substantially changes the composition of the stream or effluent. Heat transfer devices, such as but not limited to heat exchangers, preheaters, coolers, condensers, or other heat transfer equipment, and pressure devices, such as pumps, pressure regulators, compressors, or other pressure devices, are not considered to be intervening systems that change the composition of a stream or effluent, unless otherwise specified as such. Combining two streams or effluents together also is not considered to comprise an intervening system that changes the composition of one or both of the streams or effluents being combined, unless otherwise specified as such.

As used in the present disclosure, the terms "downstream" and "upstream" refer to the positioning of components or unit operations of the processing system relative to a direction of a flow of materials through the processing system. For example, a second component is considered "downstream" of a first component if materials flowing through the processing system encounter the first component before encountering the second component. Likewise, the first component is considered "upstream" of the second component if the materials flowing through the processing system encounter the first component before encountering the second component.

As used in the present disclosure, the term "effluent" refers to a stream that is passed out of a reactor, a reaction zone, or a separator following a particular reaction or separation. Generally, an effluent has a different composition than the stream that entered the reactor, reaction zone, or separator. It should be understood that when an effluent is passed to another component or system, only a portion of that effluent may be passed, unless otherwise stated. For example, a slipstream or bleed stream may carry some of the effluent away, meaning that only a portion of the effluent may enter the downstream component or system. The terms "reaction effluent" and "reactor effluent" particularly refer to a stream that is passed out of a reactor or a reaction zone.

As used in the present disclosure, the term "catalyst to oil ratio" refers to the weight ratio of a cracking catalyst, such as the FCC catalyst, to a feed, such as the hydrocarbon feed or mixture of a hydrocarbon feed and the recycled naphtha fractions.

As used in the present disclosure, the term "residence time" refers to the amount of time that reactants are in contact with a catalyst, at reaction conditions, such as at the reaction temperature.

As used in the present disclosure, the term "reactor" refers to any vessel, container, conduit, or the like, in which one or more chemical reactions, such as but not limited to catalytic cracking reactions, may occur between one or more reactants optionally in the presence of one or more catalysts. One or more "reaction zones" may be disposed within a reactor. The term "reaction zone" refers to a volume where a particular chemical reaction takes place in a reactor.

As used in the present disclosure, the terms "separation system" and "separator" refer to any separation device or collection of separation devices that at least partially separates one or more chemical constituents in a mixture from one another. For example, a separation system selectively separates different chemical constituents from one another, forming one or more chemical fractions. Examples of separation systems include, without limitation, distillation columns, fractionators, flash drums, knock-out drums, knock-out pots, centrifuges, decanters, filtration devices, traps, scrubbers, expansion devices, membranes, solvent extraction devices, adsorption devices, chemical separators, crystallizers, chromatographs, precipitators, evaporators, driers, high-pressure separators, low-pressure separators, or combinations or these. The separation processes described in the present disclosure may not completely separate all of one chemical constituent from all of another chemical constituent. Instead, the separation processes described in the present disclosure "at least partially" separate different chemical constituents from one another and, even if not explicitly stated, separation can include only partial separation.

It should further be understood that streams may be named for the components of the stream, and the component for which the stream is named may be the major component of the stream (such as comprising from 50 weight percent (wt. %), from 70 wt. %, from 90 wt. %, from 95 wt. %, from 99 wt. %, from 99.5 wt. %, or even from 99.9 wt. % of the contents of the stream to 100 wt. % of the contents of the stream, which does not include inert gases, unless otherwise indicated). It should also be understood that components of a stream are disclosed as passing from one system component to another when a stream comprising that component is disclosed as passing from that system component to another. For example, a disclosed "hydrocarbon feed stream" injected to the FCC reactor should be understood to equivalently disclose injecting the "hydrocarbon feed" to the FCC reactor, and the like.

Conventional FCC systems include an FCC reactor and a catalyst regenerator. The hydrocarbon feed may be contacted with the FCC catalyst in the FCC reactor to produce a cracking effluent. When operated under high severity conditions, the FCC reactors can produce increase concentrations of light olefins, such as but not limited to ethylene, propylene, butenes, or combinations of these light olefins. The FCC process conducted in the FCC reactors can also produce other hydrocarbons, such as but not limited to light hydrocarbon gases (C1-C4 alkanes); FCC naphtha; cycles oil, such as light cycle oil (LCO) having a boiling point of from 220° C. to 360° C. and heavy cycle oil (HCO) having a boiling point of greater than or equal to 360° C.; coke or combinations of these materials, among others. When the focus of the FCC process is on producing light olefins, the production of these byproduct streams, such as light hydrocarbon gases, FCC naphtha, and cycle oils, represents lost opportunity to produce light olefins from the FCC process. These byproduct stream, in particular the FCC naphtha streams, are generally passed to one or more downstream reactors for further conversion of the FCC naphtha streams to light olefins or other greater value petrochemical products or intermediates.

An ongoing need exists for systems and processes for increasing the yield of light olefins from hydrocarbon feeds through fluidized catalytic cracking. The systems and processes of the present disclosure are directed to FCC systems and FCC processes that increase the yield of light olefins by separating the FCC naphtha produced in the FCC reactor into a plurality of FCC naphtha fractions and injecting two or more of the FCC naphtha fractions back into the FCC reactor. Each of the FCC naphtha fractions can be defined by either boiling point range or by carbon number of the fraction, and each of the FCC naphtha fractions has a different reactivity within the FCC reactor system. Therefore, the systems and processes of the present disclosure include injecting each of the FCC naphtha fractions into the FCC reactor at different positions based on the reactivity of each of the FCC naphtha fractions. Injecting the different FCC naphtha fractions into the FCC reactor at different positions can tailor the residence time of each FCC naphtha fraction to produce greater yields of the light olefins.

The processes of the present disclosure include contacting a hydrocarbon feed with an FCC catalyst in an FCC reactor at reaction conditions that cause at least a portion of hydrocarbons from the hydrocarbon feed to undergo catalytic cracking reactions to produce a cracking effluent comprising the light olefins. The light olefins may include ethylene, propylene, butenes, or combinations of these. The processes may further include separating the cracking effluent in a cracking effluent separation system to produce a light olefin effluent and a plurality of FCC naphtha fractions, recycling at least two of the plurality of FCC naphtha fractions back to the FCC reactor, and injecting each of the FCC naphtha fractions at a different location within the FCC reactor based on the reactivity of each of the FCC naphtha fractions. The light olefin effluent may include propylene, butenes, or combinations thereof. Each FCC naphtha fraction may have a different boiling point temperature range or a different carbon number or range of carbon numbers. The constituents of all of the plurality of FCC naphtha fractions may have a number of carbon atoms between 5 and 12.

Referring now to FIG. 1, a flowchart of a process 100 for processing hydrocarbon feeds to produce light olefins through fluidized catalytic cracking, according to the present disclosure, is schematically depicted. In step S110, the hydrocarbon feed is contacted with the FCC catalyst in the FCC reactor at reaction conditions that cause at least a portion of the hydrocarbons from the hydrocarbon feed to undergo catalytic cracking reactions to produce the cracking effluent comprising the light olefins.

The hydrocarbon feed may generally comprise a hydrocarbon material. In embodiments, The hydrocarbon feed may include one or more heavy oils, such as but not limited to crude oil, bitumen, oil sands, shale oil, coal liquids, tar sands, a vacuum residue, an atmospheric residue, a vacuum gas oil, a hydrocracker bottom stream, other heavy oil streams, or combinations of these. The vacuum gas oil may have a boiling point of from 350° C. to 565° C. This range may include demetallized or deasphalted oil as well. The atmospheric residue may have a boiling point of greater than or equal to 350° C. This range may include demetallized or deasphalted oil as well. It should be understood that, as used in this disclosure, a "heavy oil" refers to a raw hydrocarbon, such as whole crude oil, which has not been previously processed through distillation, or may refer to a hydrocarbon oil, such as but not limited to a vacuum residue, atmospheric residue, vacuum gas oil, hydrocarbon bottom stream, or other heavy refinery stream, that has undergone some degree of processing prior to being introduced to the process 100 as the hydrocarbon feed. The hydrocarbon feed may have a density of greater than or equal to 0.80 grams per milliliter. The hydrocarbon feed may have a Final Boiling Point (FBP) of greater than 565° C. The hydrocarbon feed may have a concentration of nitrogen of less than or equal to 3000 parts per million by weight (ppmw).

In embodiments, the hydrocarbon feed may be a crude oil, such as whole crude oil, or synthetic crude oil. The crude oil may have an American Petroleum Institute (API) gravity of from 10 degrees to 50 degrees, such as from 10 degrees to 40 degrees, from 15 degrees to 50 degrees, from 15 degrees to 40 degrees, from 20 degrees to 50 degrees, from 20 degrees to 40 degrees, from 25 degrees to 50 degrees, or from 25 degrees to 40 degrees. For example, the hydrocarbon feed may include an extra light crude oil, a light crude oil, a medium crude oil, a heavy crude oil, or combinations of these. In embodiments, the hydrocarbon feed can be a light crude oil, such as but not limited to an Arab light export crude oil. Example properties for an exemplary grade of Arab light crude oil are provided in Table 1.

TABLE 1

| Example of AL Export Feedstock | | | |
|---|---|---|---|
| Analysis | Units | Value | Test Method |
| American Petroleum Institute (API) gravity | degree | 33.13 | ASTM D287 |
| Density | grams per milliliter (g/mL) | 0.8595 | ASTM D287 |
| Carbon Content | weight percent (wt. %) | 85.29 | ASTM D5291 |
| Hydrogen Content | wt. % | 12.68 | ASTM D5292 |
| Sulfur Content | wt. % | 1.94 | ASTM D5453 |
| Nitrogen Content | parts per million by weight (ppmw) | 849 | ASTM D4629 |
| Asphaltenes | wt. % | 1.2 | ASTM D6560 |
| Micro Carbon Residue (MCR) | wt. % | 3.4 | ASTM D4530 |
| Vanadium (V) Content | ppmw | 15 | IP 501 |
| Nickel (Ni) Content | ppmw | 12 | IP 501 |
| Arsenic (As) Content | ppmw | 0.04 | IP 501 |
| Boiling Point Distribution | | | |
| Wt. % distilled | units | Boiling Point Temp. | Test Method |
| Initial Boiling Point (IBP) | Degrees Celsius (° C.) | 33 | ASTM D7169 |
| Boiling Point (BP) at 5 wt. % | ° C. | 92 | ASTM D7169 |
| BP at 10 wt. % | ° C. | 133 | ASTM D7169 |
| BP at 20 wt. % | ° C. | 192 | ASTM D7169 |
| BP at 30 wt. % | ° C. | 251 | ASTM D7169 |
| BP at 40 wt. % | ° C. | 310 | ASTM D7169 |
| BP at 50 wt. % | ° C. | 369 | ASTM D7169 |
| BP at 60 wt. % | ° C. | 432 | ASTM D7169 |
| BP at 70 wt. % | ° C. | 503 | ASTM D7169 |
| BP at 80 wt. % | ° C. | 592 | ASTM D7169 |
| BP at 90 wt. % | ° C. | >720 | ASTM D7169 |
| BP at 95 wt. % | ° C. | >720 | ASTM D7169 |
| Final Boiling Point (FBP) | ° C. | >720 | ASTM D7169 |
| BP range C5-180° C. | wt. % | 18.0 | ASTM D7169 |
| BP range 180° C.-350 ° C. | wt. % | 28.8 | ASTM D7169 |
| BP range 350° C.-540° C. | wt. % | 27.4 | ASTM D7169 |
| BP range >540° C. | wt. % | 25.8 | ASTM D7169 |

Weight percentages in Table 1 are based on the total weight of the crude oil.

When the hydrocarbon feed comprises a crude oil, the crude oil may be a whole crude or may be a crude oil that has undergone at some processing, such as desalting, solids separation, scrubbing, or other process that does not change the composition of the hydrocarbons of the crude oil. For example, the hydrocarbon feed may be a de-salted crude oil that has been subjected to a de-salting process. In embodiments, the hydrocarbon feed may include a crude oil that has not undergone pretreatment, separation (such as distillation), or other operation or process that changes the hydrocarbon composition of the crude oil prior to introducing the crude oil to the system.

In embodiments, the hydrocarbon feed may alternatively comprise a plurality of refinery hydrocarbon streams outputted from one or more crude oil refinery operations or reactor systems. The plurality of refinery hydrocarbon streams may include but are not limited to a vacuum residue, an atmospheric residue, a vacuum gas oil, a hydrocracker bottom stream, deasphalted or demetallized oil produced by solvent deasphalting, other refinery stream, or combinations of these. In embodiments, the plurality of refinery hydrocarbon streams may be combined into the hydrocarbon feed. In embodiments, the hydrocarbon feed may be introduced directly to the FCC reactor. In embodiments, the hydrocarbon feed may include a hydrocracker bottom stream, which may be a heavy boiling fraction separated from the hydrocracker effluent produced from a hydrocracking system. In embodiments, the hydrocarbon feed may comprise, consist of, or consist essentially of a hydrocracker bottom stream. Properties of one embodiment of a hydrocracker bottom stream suitable for the hydrocarbon feed is provided below in Table 2.

TABLE 2

| Example of a Hydrocracker Bottom Stream | | | |
|---|---|---|---|
| Analysis | Units | Value | Test Method |
| Density @15.6° C. | grams per milliliter (g/mL) | 0.8293 | ASTM D287 |
| Micro Carbon Residue (MCR) | wt. % | 0.02 | ASTM D4530 |
| Nitrogen Content | parts per million by weight (ppmw) | <5 | ASTM D4629 |
| Sulfur Content | parts per million by weight (ppmw) | <50 | ASTM D4294 |
| Hydrogen Content | wt. % | 13.77 | ASTM D5292 |
| Boiling Point Distribution | | | |
| Boiling Point at wt. % distilled (IBP) | Degrees Celsius (° C.) | Boiling Point | Test Method |
| Initial Boiling Point (IBP) | ° C. | 288 | ASTM D3710 |
| Boiling Point (BP) at 5 wt. % | ° C. | 357 | ASTM D3710 |
| BP at 10 wt. % | ° C. | 378 | ASTM D3710 |
| BP at 20 wt. % | ° C. | 401 | ASTM D3710 |
| BP at 30 wt. % | ° C. | 417 | ASTM D3710 |
| BP at 40 wt. % | ° C. | 431 | ASTM D3710 |
| BP at 50 wt. % | ° C. | 442 | ASTM D3710 |
| BP at 60 wt. % | ° C. | 454 | ASTM D3710 |
| BP at 70 wt. % | ° C. | 468 | ASTM D3710 |
| BP at 80 wt. % | ° C. | 512 | ASTM D3710 |
| BP at 90 wt. % | | 536 | ASTM D3710 |
| Final Boiling Point (FBP) | ° C. | 608 | ASTM D3710 |

Weight percentages in Table 1 are based on the total weight of the crude oil.

In embodiments, the hydrocarbon feed may be a hydrocracker bottom stream having a density of greater than 0.8. In embodiments, the hydrocarbon feed can be a hydrocracker bottoms having a boiling point profile as described by the 5 wt. % boiling temperature, the 25 wt. % boiling temperature, the 50 wt. % boiling temperature, the 75 wt. % boiling temperature, and the 95 wt. % boiling temperature. These respective boiling temperatures correspond to the temperatures at which a given weight percentage of the hydrocarbon feed stream boils. In embodiments, the hydrocracker bottoms may have one or more of a 5 wt. % boiling temperature of less than or equal to 375° C.; a 20 wt. % boiling temperature of less than or equal to 425° C.; a 50 wt. % boiling temperature of less than or equal to 450° C.; a 70 wt. % boiling temperature of less than 475° C.; a 95 wt. % boiling temperature of less than or equal to 550° C.; or combinations of these. In embodiments, the hydrocracker bottoms may have one or more of a 5 wt. % boiling temperature of from 325° C. to 375° C.; a 20 wt. % boiling temperature of from 375° C. to 425° C., a 50 wt. % boiling temperature of from 425° C. to 450° C., a 70 wt. % boiling temperature of from 450° C. to 500° C. and a Final Boiling Point temperature of from 550° C. to 650° C., such as from 550° C. to 800° C.

Referring again to FIG. 1, the hydrocarbon feed may be contacted with an FCC catalyst in an FCC reactor at reaction conditions that cause at least a portion of hydrocarbons from the hydrocarbon feed to undergo catalytic cracking reactions to a cracking effluent comprising the light olefins. In embodiments, the hydrocarbon feed may be catalytically cracked in a riser reactor, a downer reactor, or both. The FCC reactor system can include one or a plurality of FCC reactors, with one or a plurality of catalyst regenerators.

In embodiments, the FCC reactor may be operated at a reaction temperature of at least about 500° C., such as a reaction temperature of from 500° C. to 800° C., from 510° C. to 800° C., from 550° C. to 800° C., from 600° C. to 800° C., from 650° C. to 800° C., from 500° C. to 750° C., from 510° C. to 750° C., from 550° C. to 750° C., from 600° C. to 750° C., from 650° C. to 750° C., from 500° C. to 700° C., from 510° C. to 700° C., from 550° C. to 700° C., from 600° C. to 700° C., from 650° C. to 700° C., from 500° C. to 650° C., from 510° C. to 650° C., from 550° C. to 650° C., from 600° C. to 650° C., from 500° C. to 600° C., from 510° C. to 600° C., from 500° C. to 550° C., or from 510° C. to 550° C.

In embodiments, the residence time of the hydrocarbon feed in contact with the FCC catalyst in the FCC reactor may be from 0.1 seconds to 60 seconds, from 1 second to 60 seconds, from 5 seconds to 60 seconds, from 8 seconds to 60 seconds, from 10 seconds to 60 seconds, from 15 seconds to 60 seconds, from 20 seconds to 60 seconds, from 25 seconds to 60 seconds, from 0.1 seconds to 50 seconds, from 1 second to 50 seconds, from 5 seconds to 50 seconds, from 8 seconds to 50 seconds, from 10 seconds to 50 seconds, from 15 seconds to 50 seconds, from 20 seconds to 50 seconds, from 25 seconds to 50 seconds, from 0.1 seconds to 40 seconds, from 1 second to 40 seconds, from 5 seconds to 40 seconds, from 8 seconds to 40 seconds, from 10 seconds to 40 seconds, from 15 seconds to 40 seconds, from 20 seconds to 40 seconds, from 25 seconds to 40 seconds, from 0.1 seconds to 35 seconds, from 1 second to 35 seconds, from 5 seconds to 35 seconds, from 8 seconds to 35 seconds, from 10 seconds to 35 seconds, from 15 seconds to 35 seconds, from 20 seconds to 35 seconds, or from 25 seconds to 35 seconds. In embodiments, the residence time of the hydrocarbon feed in the FCC reactor may be about 30 seconds.

In embodiments, the weight ratio of the FCC catalyst to hydrocarbons (catalyst to oil ratio) in the FCC reactor may be from 1 to 40, such as from 1 to 30, from 1 to 20, from 1 to 10, from 1 to 8, from 2 to 40, from 2 to 30, from 2 to 20, from 2 to 10, from 2 to 8, from 3 to 40, from 3 to 30, from 3 to 20, from 3 to 10, or from 3 to 8. In embodiments, the catalyst to oil ratio in the FCC reactor may be about 5. The hydrocarbons may include hydrocarbons from the hydrocarbon feed, hydrocarbons from the FCC naphtha fractions injected into the FCC reactor, or combinations of these hydrocarbons.

In embodiments, steam may be injected into the FCC reactor. The hydrocarbon feed may be catalytically cracked in the presence of the steam with the FCC catalyst. The steam to the hydrocarbon mass ratio in the FCC reactor may be from 0.2 to 0.8, from 0.3 to 0.8, from 0.4 to 0.8, from 0.5 to 0.8, from 0.2 to 0.7, from 0.3 to 0.7, from 0.4 to 0.7, from 0.5 to 0.7, from 0.2 to 0.6, from 0.3 to 0.6, from 0.4 to 0.6, or from 0.5 to 0.6. Steam may refer to all water in the FCC reactor.

In embodiments, one or more supplemental feed streams (not shown) may be combined with the hydrocarbon feed before introduction of the hydrocarbon feed to the FCC reactor. In other embodiments, one or more supplemental feed streams may be added directly to the FCC reactor, where the supplemental feed stream may be mixed with the hydrocarbon feed 102 and the FCC catalyst prior to introduction into the FCC reactor.

The FCC catalyst may be suitable for use in the FCC reactor. The FCC catalyst may be a heat carrier and may provide heat transfer to the hydrocarbon feed in the FCC reactor. The FCC catalyst may also have a plurality of catalytically active sites, such as acidic sites for example, that promote the cracking reaction. For example, in embodiments, the FCC catalyst may be a high-activity FCC catalyst having high catalytic activity. Examples of fluid catalytic cracking FCC catalysts suitable for use in the system for producing light olefins through FCC may include, without limitation, zeolites, silica-alumina catalysts, carbon monoxide burning promoter additives, bottoms cracking additives, light olefin-producing additives, other catalyst additives, or combinations of these components. Zeolites that may be used as at least a portion of the FCC catalyst for cracking may include, but are not limited to Y, REY, USY, RE-USY zeolites, or combinations of these. The FCC catalyst may also include a shaped selective catalyst additive, such as ZSM-5 zeolite crystals or other pentasil-type catalyst structures, which are often used in other FCC processes to produce light olefins and/or increase FCC gasoline octane. In one or more embodiments, the FCC catalyst may include a mixture of a ZSM-5 zeolite crystals and the cracking FCC catalyst zeolite and matrix structure of a typical FCC catalyst. In one or more embodiments, the FCC catalyst may be a mixture of Y and ZSM-5 zeolite catalysts embedded with clay, alumina, and binder.

In embodiments, at least a portion of the FCC catalyst may be modified to include one or more rare earth elements (15 elements of the Lanthanide series of the IUPAC Periodic Table plus scandium and yttrium), alkaline earth metals (Group 2 of the IUPAC Periodic Table), transition metals, phosphorus, fluorine, or any combination of these, which may enhance olefin yield in the FCC reactor. Transition metals may include "an element whose atom has a partially filled d sub-shell, or which can give rise to cations with an incomplete d sub-shell" [IUPAC, Compendium of Chemical Terminology, 2nd ed. (the "Gold Book") (1997). Online corrected version: (2006-) "transition element"]. The zeolite used in the FCC catalyst may be post-modified by titanium, zirconium, or both by inserting the titanium, zirconium, or both into the framework of the zeolite or by doping the titanium, zirconium, or both onto the surfaces of the zeolite.

Contacting the hydrocarbon feed with the cracking catalyst in the FCC reactor may cause at least a portion of the hydrocarbons in the hydrocarbon feed to undergo cracking reactions to produce a reaction effluent comprising at least reaction products, unreacted hydrocarbons, and used cracking catalyst. The reaction products may comprise light olefins, such as but not limited to ethylene, propylene, butenes, or combinations of these light olefins. Downstream of the FCC reactor, the reaction effluent may be passed to a fluid-solid separator operable to separate the used cracking catalyst from the reaction effluent to produce a cracking effluent comprising the reaction products, unreacted hydrocarbons, and other fluids (liquids or gases).

Referring again to FIG. 1, in step S120, the cracking effluent from the FCC reactor may be separated into various product effluents and intermediate streams in a cracking effluent separation system disposed downstream of the FCC reactor. In embodiments, the cracking effluent separation system may include a vapor-liquid separator such as a flash drum (sometimes referred to as a breakpot, knock-out drum, knock-out pot, compressor suction drum, or compressor inlet drum). In embodiments, the cracking effluent separation system may include a fractionation column operable to separate the cracking effluent by differences in boiling temperatures into the various product effluents and intermediate streams. In embodiments, steam may be introduced to the FCC reactor, and the cracking effluent separation system may be operable to separate the cracking effluent to produce an aqueous stream in addition to the product effluents and intermediate streams. The product effluents may include the light olefin effluent comprising the propylene, butenes, or combinations of these light olefins. The intermediate streams may include the FCC naphtha, FCC naphtha fractions, one or more heavy streams, or combinations of these.

The cracking effluent may be separated in a cracking effluent separation system to produce the light olefin effluent and the plurality of FCC naphtha fractions. The cracking effluent separation system may be disposed downstream of the FCC reactor. The cracking effluent may be passed directly from the FCC reactor to the cracking effluent separation system without passing through an intervening reaction system or separation system that substantially changes the composition of the cracking effluent. In embodiments, the cracking effluent may be separated in a cracking effluent separation system to produce at least the light olefin effluent, the plurality of FCC naphtha fractions, a light gas fraction, and a heavy fraction (constituents having boiling point temperatures greater than the FCC naphtha fractions). In embodiments, the light olefin effluent may comprise propylene, butenes, or combinations thereof. In embodiments, the light gas fraction may comprise C1-C2 saturated hydrocarbons, hydrogen, or other light gases. In embodiments, the heavy fraction may comprise hydrocarbons having boiling point temperatures greater than the FCC naphtha fractions, such as hydrocarbons having greater than 12 carbon atoms (boiling point temperatures greater than 220° C.). In embodiments, the cracking effluent may be separated in the cracking effluent separation system to produce the light olefin product, an FCC naphtha stream comprising constituents having from boiling point temperatures between 35° C. and 220° C., a light gas fraction, and a heavy fraction, and the FCC naphtha stream may be subsequently separated into the plurality of FCC naphtha fractions.

Each FCC naphtha fraction may have a different boiling point temperature range. In embodiments, the plurality of FCC naphtha fractions may comprise a first light naphtha fraction having a boiling point temperature range of from 20 Celsius (° C.) to 50° C., from 27° C. to 50° C., or from 36° C. to 50° C., a second light naphtha fraction having a boiling point temperature range of from 50° C. to 75° C., a third light naphtha fraction having a boiling point temperature range of from 75° C. to 100° C., a middle naphtha fraction having a boiling point temperature range of from 100° C. to 160° C., and a heavy naphtha fraction having a boiling point temperature range of from 160° C. to 220° C. In embodiments, the plurality of FCC naphtha fractions may comprise a first light naphtha fraction having a boiling point of from 20° C. to 50° C., from 27° C. to 50° C., or from 36° C. to 50° C., a second light naphtha fraction having a boiling point of from 50° C. to 75° C., and a third light naphtha fraction having a boiling point of from 75° C. to 100° C.

The constituents of all of the plurality of FCC naphtha fractions may have a number of carbon atoms between 5 and 12. In embodiments, the plurality of FCC naphtha fractions may comprise a first light naphtha fraction having a number of carbon atoms of 5 and 6, a second light naphtha fraction having a number of carbon atoms of 7 and 8, a third light naphtha fraction having a number of carbon atoms of 9 and 10, and a fourth light naphtha fraction having a number of carbon atoms of 11 and 12.

In embodiments, the plurality of FCC naphtha fractions may comprise an FCC C5 naphtha fraction comprising constituents having 5 carbon atoms, an FCC C6 naphtha fraction comprising constituents having 6 carbon atoms, an FCC C7 naphtha fraction comprising constituents having 7 carbon atoms, an FCC C8 naphtha fraction comprising constituents having 8 carbon atoms, an FCC C9 naphtha fraction comprising constituents having 9 carbon atoms, an FCC C10 naphtha fraction comprising constituents having 10 carbon atoms, an FCC C11 naphtha fraction comprising constituents having 11 carbon atoms, and an FCC C12 naphtha fraction comprising constituents having 12 carbon atoms.

Referring still to FIG. 1, in step S130, the plurality of FCC naphtha fractions may be recycled back to the FCC reactor. The plurality of FCC naphtha fractions may be passed from the cracking effluent separation system to the FCC reactor. In embodiments, when the plurality of FCC naphtha fractions comprise a first light naphtha fraction having a boiling point temperature range of from 20° C. to 50° C., from 27° C. to 50° C., or from 36° C. to 50° C., a second light naphtha fraction having a boiling point temperature range of from 50° C. to 75° C., a third light naphtha fraction having a boiling point temperature range of from 75° C. to 100° C., a middle naphtha fraction having a boiling point temperature range of from 100° C. to 160° C., and a heavy naphtha fraction having a boiling point temperature range of from 160° C. to 220° C., the first light naphtha fraction, the second light naphtha fraction, and the third light fraction may be recycled back to the FCC reactor. The middle naphtha fraction, and the heavy naphtha fraction may not be recycled back to the FCC reactor. In embodiments, the middle naphtha fraction and the heavy naphtha fraction may instead be passed to one or more downstream processes, such as naphtha reforming processes, hydrocracking process, fuel blending, or other process, for further conversion of the middle naphtha fraction and heavy naphtha fraction. In embodiments, the middle naphtha fraction, the heavy naphtha fraction, or both may be recycled back to the FCC reactor. In embodiments, first light naphtha fraction, the second light naphtha fraction, the third light fraction, the middle naphtha fraction, and the heavy naphtha fraction may all be recycled back to the FCC reactor.

Referring again to FIG. 1, in step S140, each of the at least two of the plurality of FCC naphtha fractions may be injected at a different location within the FCC reactor based on the reactivity of each of the at least two of the plurality of FCC naphtha. Each of the FCC naphtha fractions recycled back to the FCC reactor may have a different reactivity, reaction rates, or both and may require different residence times in the FCC reactor to produce the desired light olefins, such as ethylene, propylene, butenes, or combinations of these. Injecting each of the FCC naphtha fractions at a different location in the FCC reactor may cause each of the FCC naphtha fractions to have a different time of contacting with the FCC catalyst.

The FCC naphtha fractions with a greater number of carbon atoms, or greater boiling point temperatures, may tend to be more reactive to produce paraffins, olefin, or both, requiring less cracking activity compared to the FCC naphtha fractions having a lower number of carbon atoms, or lower boiling points. The FCC naphtha fractions with a greater number of carbon atoms, or greater boiling point temperatures may have higher reactivity compared to the FCC naphtha fractions having a lower number of carbon atoms, or lower boiling point temperatures. Because of the greater reactivity, the FCC naphtha fractions with a greater number of carbon atoms or greater boiling point temperatures may require a shorter residence time in the FCC reactor to produce the light olefins compared to the FCC naphtha fractions having a lower number of carbon atoms, or lower boiling point temperatures. Recycling each of the plurality of the FCC naphtha fractions by injecting at a different location of with the FCC reactor may enable control of the reactivity of paraffin, olefin, or both, to adjust for the difference in relative reactivity of the FCC naphtha fractions, and thereby increasing the yield of the light olefins. The FCC naphtha fractions having a higher number of carbon atoms, or higher boiling points, may have a shorter residence time in the FCC reactor compared to the FCC naphtha fractions having a lower number of carbon atoms.

When the residence time for a particular FCC naphtha fraction is too short, the duration of contact between the hydrocarbons in the FCC naphtha fraction and the cracking catalyst in the cracking reactor may not be sufficient to cause a significant amount of the hydrocarbons in the FCC naphtha fraction to undergo cracking reactions to produce olefins, and most of the FCC naphtha fraction may pass through the FCC reactor without reaction. If the residence time for a particular FCC naphtha fraction is too long, the hydrocarbons in the FCC naphtha fraction may undergo cracking reactions to form olefins, which may then react further to produce light hydrocarbon gases or other non-olefin compounds, which may decrease the yield of light olefins. Thus, injecting each FCC naphtha fraction at the appropriate location in the FCC reactor can provide the sufficient residence time for each FCC naphtha fraction to produce light olefins, but not so much that those olefins continue to react to produce light hydrocarbon gases.

In embodiments, when the plurality of FCC naphtha fractions comprise a first light naphtha fraction having a boiling point temperature range of from 20° C. to 50° C., from 27° C. to 50° C., or from 36° C. to 50° C., a second light naphtha fraction having a boiling point temperature range of from 50° C. to 75° C., a third light naphtha fraction having a boiling point temperature range of from 75° C. to 100° C., the first light naphtha fraction may have a longer residence time compared to the second light naphtha fraction and the third light naphtha fraction. The first light naphtha fraction may be injected into the FCC reactor upstream of injecting the second light naphtha fraction and the third light naphtha fraction. The second light naphtha fraction may have a longer residence time compared to the third light naphtha fraction, but a shorter residence time compared to the first light naphtha fraction. The second light naphtha fraction may be injected into the FCC reactor at a location upstream of injecting the third light naphtha fraction and downstream of injecting the first naphtha fraction.

In embodiments, when the plurality of FCC naphtha fractions comprise a first light naphtha fraction having a number of carbon atoms of 5 and 6, a second light naphtha fraction having a number of carbon atoms of 7 and 8, a third light naphtha fraction having a number of carbon atoms of 9 and 10, and a fourth light naphtha fraction having a number of carbon atoms of 11 and 12, the first light naphtha fraction may have a longer residence time compared to the second light naphtha fraction, the third light naphtha fraction, and the fourth light naphtha fraction. The first light naphtha fraction may be injected into the FCC reactor at a point upstream of injecting the second light naphtha fraction, the third light naphtha fraction, and the fourth light naphtha fraction. The second light naphtha fraction may have a longer residence time compared to the third light naphtha fraction, and the fourth light naphtha fraction. The second light naphtha fraction may be injected into the FCC reactor at a point upstream of injecting the third light naphtha fraction, and the fourth light naphtha fraction and downstream of injecting the first light naphtha fraction. The third light naphtha fraction may have a longer residence time compared to the fourth light naphtha fraction, but less than the first light naphtha fraction and the second light naphtha fraction. The third light naphtha fraction may be injected into the FCC reactor at a point upstream of injecting the fourth light naphtha fraction and downstream of injecting the first light naphtha stream and the second light naphtha stream. The fourth light naphtha fraction may have the lowest residence time and may be injected into the FCC reactor at a point up downstream of the third light naphtha fraction.

In embodiments, when the plurality of FCC naphtha fractions comprise an FCC C5 naphtha fraction comprising constituents having 5 carbon atoms, an FCC C6 naphtha fraction comprising constituents having 6 carbon atoms, an FCC C7 naphtha fraction comprising constituents having 7 carbon atoms, an FCC C8 naphtha fraction comprising constituents having 8 carbon atoms, an FCC C9 naphtha fraction comprising constituents having 9 carbon atoms, an FCC C10 naphtha fraction comprising constituents having 10 carbon atoms, an FCC C11 naphtha fraction comprising constituents having 11 carbon atoms, and an FCC C12 naphtha fraction comprising constituents having 12 carbon atom, the FCC C5 naphtha fraction may have a longer residence time compared to the FCC C6 naphtha fraction, the FCC C7 naphtha fraction, the FCC C8 naphtha fraction, the FCC C9 naphtha fraction, the FCC C10 naphtha fraction, the FCC C11 naphtha fraction, and the FCC C12 naphtha fraction. The FCC C5 naphtha fraction may be injected into the FCC reactor at a point upstream of injecting the FCC C6 naphtha fraction, the FCC C7 naphtha fraction, the FCC C8 naphtha fraction, the FCC C9 naphtha fraction, the FCC C10 naphtha fraction, the FCC C11 naphtha fraction, and the FCC C12 naphtha fraction. The FCC C6 naphtha fraction may have a longer residence time compared to the FCC C7 naphtha fraction, the FCC C8 naphtha fraction, the FCC C9 naphtha fraction, the FCC C10 naphtha fraction, the FCC C11 naphtha fraction, and the FCC C12 naphtha fraction, but less than the FCC C5 naphtha fraction. The FCC C6 naphtha fraction may be injected into the FCC reactor at a point upstream of injecting the FCC C7 naphtha fraction, the FCC C8 naphtha fraction, the FCC C9 naphtha fraction, the FCC C10 naphtha fraction, the FCC C11 naphtha fraction, and the FCC C12 naphtha fraction and downstream of injecting the FCC C5 naphtha fraction. The FCC C7 naphtha fraction may have a longer residence time compared to the FCC C8 naphtha fraction, the FCC C9 naphtha fraction, the FCC C10 naphtha fraction, the FCC C11 naphtha fraction, and the FCC C12 naphtha fraction, but less than the FCC C5 naphtha fraction, and the FCC C6 naphtha fraction. The FCC C7 naphtha fraction may be injected into the FCC reactor at a point upstream of injecting the FCC C8 naphtha fraction, the FCC C9 naphtha fraction, the FCC C10 naphtha fraction, the FCC C11 naphtha fraction, and the FCC C12 naphtha fraction and downstream of injecting the FCC C5 naphtha fraction, and the FCC C6 naphtha fraction. The FCC C8 naphtha fraction may have a longer residence time compared to the FCC C9 naphtha fraction, the FCC C10 naphtha fraction, the FCC C11 naphtha fraction, and the FCC C12 naphtha fraction, but less than the FCC C5 naphtha fraction, the FCC C6 naphtha fraction, and the FCC C7 naphtha fraction. The FCC C8 naphtha fraction may be injected into the FCC reactor at a point upstream of injecting the FCC C9 naphtha fraction, the FCC C10 naphtha fraction, the FCC C11 naphtha fraction, and the FCC C12 naphtha fraction and downstream of injecting the FCC C5 naphtha fraction, the FCC C6 naphtha fraction, and the FCC C7 naphtha fraction. The FCC C9 naphtha fraction may have a longer residence time compared to the FCC C10 naphtha fraction, the FCC C11 naphtha fraction, and the FCC C12 naphtha fraction, but less than the FCC C5 naphtha fraction, the FCC C6 naphtha fraction, the FCC C7 naphtha fraction, and the FCC C8 naphtha fraction. The FCC C9 naphtha fraction may be injected into the FCC reactor at a point upstream of injecting the FCC C10 naphtha fraction, the FCC C11 naphtha fraction, and the FCC C12 naphtha fraction and downstream of injecting the FCC C5 naphtha fraction, the FCC C6 naphtha fraction, the FCC C7 naphtha fraction, and the FCC C8 naphtha fraction. The FCC C10 naphtha fraction may have a longer residence time compared to the FCC C11 naphtha fraction, and the FCC C12 naphtha fraction, but less than the FCC C5 naphtha fraction, the FCC C6 naphtha fraction, the FCC C7 naphtha fraction, the FCC C8 naphtha fraction, and the FCC C9 naphtha fraction. The FCC C10 naphtha fraction may be injected into the FCC reactor at a point upstream of injecting the FCC C11 naphtha fraction, and the FCC C12 naphtha fraction and downstream of injecting the FCC C5 naphtha fraction, the FCC C6 naphtha fraction, the FCC C7 naphtha fraction, the FCC C8 naphtha fraction, and the FCC C9 naphtha fraction. The FCC C11 naphtha fraction may have a longer residence time compared to the FCC C12 naphtha fraction, but less than the FCC C5 naphtha fraction, the FCC C6 naphtha fraction, the FCC C7 naphtha fraction, the FCC C8 naphtha fraction, the FCC C9 naphtha fraction, and the FCC C10 naphtha fraction. The FCC C11 naphtha fraction may be injected into the FCC reactor at a point upstream of injecting the FCC C12 naphtha fraction and downstream of injecting the FCC C5 naphtha fraction, the FCC C6 naphtha fraction, the FCC C7 naphtha fraction, the FCC C8 naphtha fraction, the FCC C9 naphtha fraction, and the FCC C10 naphtha fraction.

In embodiments, when the plurality of FCC naphtha fractions comprise an FCC C5 naphtha fraction comprising constituents having 5 carbon atoms, an FCC C6 naphtha fraction comprising constituents having 6 carbon atoms, an FCC C7 naphtha fraction comprising constituents having 7 carbon atoms, an FCC C8 naphtha fraction comprising constituents having 8 carbon atoms, an FCC C9 naphtha fraction comprising constituents having 9 carbon atoms, an FCC C10 naphtha fraction comprising constituents having 10 carbon atoms, an FCC C11 naphtha fraction comprising constituents having 11 carbon atoms, and an FCC C12 naphtha fraction comprising constituents having 12 carbon atoms, the FCC C5 naphtha fraction, the FCC C6 naphtha fraction, and the FCC C7 naphtha fraction may be recycled back to the FCC reactor. The FCC C8 naphtha fraction, the FCC C9 naphtha fraction, the FCC C10 naphtha fraction, the FCC C11 naphtha fraction, and the FCC C12 naphtha fraction may not be recycled back to the FCC reactor. The FCC C5 naphtha fraction may have a longer residence time compared to the FCC C6 naphtha fraction and the FCC C7 naphtha fraction. The FCC C5 naphtha fraction may be injected into the FCC reactor at a point upstream of injecting the FCC C6 naphtha fraction and the FCC C7 naphtha fraction. The FCC C6 naphtha fraction may have a longer residence time compared to the FCC C7 naphtha fraction, but a shorter residence time compared to the FCC C5 naphtha fraction. The FCC C6 naphtha fraction may be injected into the FCC reactor at a point upstream of injecting the FCC C7 naphtha fraction and downstream of injecting the FCC C5 naphtha fraction.

Figure 2:
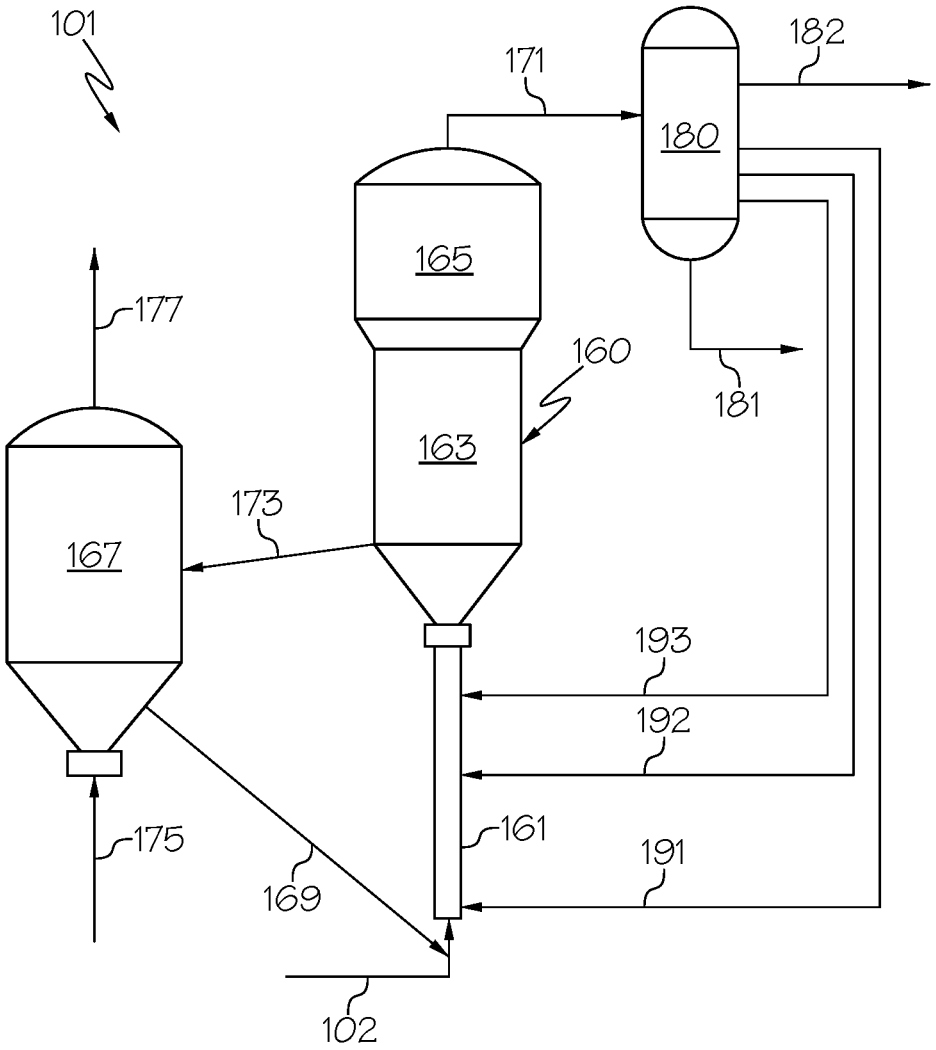
FIG. 2 schematically depicts a generalized flow diagram of a system for processing hydrocarbon feeds to produce light olefins through fluidized catalytic cracking, according to one or more embodiments shown and described in the present disclosure.

Referring now to FIG. 2, a generalized flow diagram of one embodiment of a system 101 for processing hydrocarbon feeds to produce light olefins through fluidized catalytic cracking is schematically depicted. Referring to FIG. 2, the system 101 for producing light olefins through FCC includes the FCC reactor 160, the catalyst regenerator 167, and the cracking effluent separation system 180 downstream of the FCC reactor 160. The FCC reactor 160 may comprise a riser reactor 161 that operates under conditions that promote formation of light olefins and that minimize light olefin-consuming reactions including hydrogen-transfer reactions. The FCC reactor 160 may further include a downstream reaction zone 163, which is disposed downstream of the riser reactor 161, and a separation zone 165, which is downstream of the downstream reaction zone 163. The FCC reactor 160 also includes a regeneration vessel 167 for regenerating spent FCC catalyst. The hydrocarbon feed 102 is introduced to the riser reactor 161. In embodiments, the hydrocarbon feed 102 may be introduced to the riser reactor 161 along with steam or other suitable gas for atomization of the feed (not shown). In embodiments, the hydrocarbon feed 102 may be admixed and intimately contacted with an effective quantity of heated fresh or regenerated cracking catalyst that are conveyed through a conduit 169 from regeneration vessel 167. The hydrocarbon feed 102 and the cracking catalyst are contacted under conditions to form a suspension that is introduced into the riser reactor 161. In a continuous process, the mixture of the cracking catalyst and hydrocarbon feed 102 proceeds upward through the riser reactor 161 into the downstream reaction zone 163. In the riser reactor 161 and downstream reaction zone 163, the contact of the hydrocarbons in the hydrocarbon feed 102 with the cracking catalyst may cause at least a portion of the hydrocarbons from the hydrocarbon feed 102 to undergo cracking reactions to produce reaction products, which may include light olefins, such as ethylene, propylene, butenes, or combinations of these. In embodiments, the reaction products may comprise propylene.

The FCC reactor 160 may be operated at any of the operating conditions previously discussed in the present disclosure. In embodiments, the FCC reactor 160 may be operated at operating conditions that include: a reaction temperature of from 480° C. to 800° C., from 480° C. to 650° C., from 480° C. to 620° C., or from 480° C. to 600° C., from 500° C. to 800° C., from 500° C. to 650° C., from 500° C. to 620° C., from 500° C. to 600° C., or from 500° C. to 550° C.; a reaction pressure of from 1 kg/cm$^2$ (98.07 Kilopascal (kPa)) to 20 kg/cm$^2$ (1961.33 kPa), from 1 kg/cm$^2$ (98.07 kPa) to 10 kg/cm$^2$ (980.67 kPa), or from 1 kg/cm$^2$ (98.07 kPa) to 3 kg/cm$^2$ (294.2 kPa); a contact time (in the reactor) of from 0.1 seconds to 60 seconds, from 1 second to 50 seconds, from 10 second to 40 seconds, from 20 second to 60 seconds, or from 20 second to 40 seconds; and a catalyst to hydrocarbon feed ratio of from 1:1 to 40:1, 1:1 to 20:1, from 1:1 to 10:1, or from 3:1 to 6:1.

During the reaction, the cracking catalyst may become coked and hence access to the active catalytic sites is limited or nonexistent. A spent FCC catalyst may be separated from the cracking effluent. The hydrocarbon feed may be combined with an FCC catalyst and cracked into a mixture of the spent FCC catalyst and the cracking effluent. The spent FCC catalyst may be passed to a catalyst regenerator. The spent FCC catalyst in the catalyst regenerator may be regenerated to produce a regenerated FCC catalyst. The regenerated FCC catalyst may have a catalytic activity that is at least greater than the catalytic activity of the spent FCC catalyst. The regenerated FCC catalyst may then be recycled back to the FCC reactor.

When the portion of the hydrocarbon feed contacts the hot FCC catalyst and is cracked to lighter products, carbonaceous deposits, commonly referred to as coke, form on the FCC catalyst. The coke deposits formed on the FCC catalyst may reduce the catalytic activity of the FCC catalyst or deactivate the FCC catalyst. Deactivation of the FCC catalyst may result in the FCC catalyst becoming catalytically ineffective. The spent FCC catalyst having coke deposits may be separated from the cracking reaction products, stripped of removable hydrocarbons, and passed to a regeneration process where the coke is burned from the FCC catalyst in the presence of air to produce a regenerated catalyst that is catalytically effective. The term "catalytically effective" refers to the ability of the regenerated FCC catalyst to increase the rate of cracking reactions. The term "catalytic activity" refers to the degree to which the regenerated FCC catalyst increases the rate of the cracking reactions and may be related to a number of catalytically active sites available on the catalyst. For example, coke deposits on the FCC catalyst may cover up or block catalytically active sites on the spent catalyst, thus, reducing the number of catalytically active sites available, which may reduce the catalytic activity of the FCC catalyst. Following regeneration, the regenerated FCC catalyst may have equal to or less than 10 wt. %, 5 wt. %, or even 1 wt. % coke based on the total weight of the regenerated FCC catalyst. The combustion products may be removed from the regeneration process as a flue gas stream. The heated regenerated FCC catalysts may then be recycled back to the cracking reaction zone of the FCC reactor.

Additionally, the temperature of the cracking catalyst may be reduced through contact with the hydrocarbon feed 102. The reaction effluent may comprise used cracking catalyst, reaction products, and unreacted hydrocarbons. The used cracking catalyst may be separated from the reaction effluent to produce the cracked effluent. The cracked effluent may be separated from the used cracking catalyst using any suitable configuration known in an FCC reactor 160, generally referred to as the separation zone 165 in the FCC reactor 160, for instance, located at the top of the FCC reactor 160 above the reaction zone 163. The separation zone 165 may include any suitable fluid-solid separation apparatus known to those of ordinary skill in the art such as, for example, cyclones. The cracking effluent 171, which includes the reaction products, may be withdrawn from the separation zone 165 and passed to the cracking effluent separation system 180. The used cracking catalyst containing coke deposits may be passed through the conduit 173 to the regeneration vessel 167.

In the regeneration vessel 167, the used cracking catalyst be contacted with a stream of oxygen-containing gas, e.g., pure oxygen or air, which enters the regeneration vessel 167 through the conduit 175. The regeneration vessel 167 may be operated in a configuration and under conditions that are known in typical a fluidized catalytic cracking operations. For instance, the regeneration vessel 167 can operate as a fluidized bed to produce regeneration off-gas comprising combustion products which are discharged through a conduit 177. Regeneration of the used cracking catalyst may include combusting the coke deposits to remove the coke deposits from the cracking catalyst, heating the cracking catalyst, or both to produce a hot regenerated cracking catalyst. The hot regenerated cracking catalyst may be transferred from the regeneration vessel 167 through the conduit 169 to the bottom portion of the riser reactor 161, where the hot regenerated cracking catalyst can be admixed with the hydrocarbon feed 102 upstream of the riser reactor 161.

Referring still to FIG. 2, the cracking effluent 171 may be separated in the cracking effluent separation system 180 to produce the cycle oil stream 181, the light olefin effluent 182 and a plurality of FCC naphtha fractions. The light olefin effluent 182 may comprise ethylene, propylene, butenes, or combinations thereof. In embodiments, the light olefin effluent 182 may comprise propylene. In embodiments, the FCC naphtha fractions may include the first light naphtha fraction 191, the second light naphtha fraction 192, and the third light naphtha fraction 193, as shown in FIG. 2. Though not shown in FIG. 2, it is understood that the FCC naphtha fractions may include any of the FCC naphtha fractions previously discussed in the present application, such as but not limited the middle naphtha fraction, the heavy naphtha fraction, or any of the naphtha fractions having specific numbers or carbon atoms or boiling point ranges. The cycle oil stream 181 may include constituents of the cracking effluent 171 having boiling point temperatures greater than 220° C., and may include light cycle oil (LCO), heavy cycle oil (HCO), or combinations of these.

At least two of the plurality of FCC naphtha fractions may be recycled back to the riser reactor 161. In embodiments, the FCC naphtha fractions recycled back to the riser reactor 161 may comprise a first light naphtha fraction 191 having a first reactivity, a second light naphtha fraction 192 having a second reactivity, and a third light naphtha fraction 193 having a third reactivity, where the third reactivity is higher than the second reactivity, and the second reactivity is higher than the first reactivity. The first light naphtha fraction 191 may be injected at a first location of the riser reactor 161. The second light naphtha fraction 192 may be injected in a second location of the riser reactor 161. The third light naphtha fraction 193 may be injected at a third location of the riser reactor 161. The third location may be located vertically higher than the first location. The second location may be located vertically higher than the first location. The second location may be between the first location and the third location. In other words, the second location may be downstream of the first location, and the third location may be downstream of the second location. The first light naphtha fraction 191 may have a first residence time in the FCC reactor 160, the second light naphtha fraction 192 may have a second residence time in the FCC reactor 160, and the third light naphtha fraction 193 may have a third residence time in the FCC reactor 160, where the first residence time is longer than the second residence time, and the second residence time is longer than the third residence time.

In embodiments, the plurality of FCC naphtha fractions recycled back to the riser reactor 161 may comprise a first light naphtha fraction having a boiling point temperature range of from 20° C. to 50° C., from 27° C. to 50° C., or from 36° C. to 50° C., a second light naphtha fraction having a boiling point temperature range of from 50° C. to 75° C., a third light naphtha fraction having a boiling point temperature range of from 75° C. to 100° C., and the first light naphtha fraction may have a longer residence time in the riser reactor 161 compared to the second light naphtha fraction and the third light naphtha fraction. The first light naphtha fraction may be injected in a first location of the FCC reactor 160, where the first location is located vertically lower than a second location of the second light naphtha fraction and a third location of the third light naphtha fraction. The second light naphtha fraction may have a longer residence time compared to the third light naphtha fraction, but shorter residence time compared to the first light naphtha fraction. The second light naphtha fraction may be injected in a second location of the FCC reactor 160, which is located vertically lower than a third location of the third light naphtha fraction, but higher than the first location of the first light naphtha fraction. In embodiments, the first location of injection of the first light naphtha fraction may be upstream of the second location of injection of the second light naphtha fraction, and the second location of injection of the second light naphtha fraction may be upstream of the third location of injection of the third light naphtha fraction.

In embodiments, the FCC naphtha fractions recycled back to the riser reactor 161 may comprise a first light naphtha fraction having a number of carbon atoms of 5 and 6, a second light naphtha fraction having a number of carbon atoms of 7 and 8, a third light naphtha fraction having a number of carbon atoms of 9 and 10, and a fourth light naphtha fraction having a number of carbon atoms of 11 and 12, and the first light naphtha fraction may have a longer residence time compared to the second light naphtha fraction, the third light naphtha fraction, and the fourth light naphtha fraction. The first light naphtha fraction may be injected in a first location of the FCC reactor 160, which is located vertically lower than a second location of injection of the second light naphtha fraction, a third location of injection of the third light naphtha fraction, and a fourth location of injection of the fourth light naphtha fraction. The second light naphtha fraction may have a longer residence time compared to the third light naphtha fraction, and the fourth light naphtha fraction, but shorter than the first light naphtha fraction. The second light naphtha fraction may be injected at a second location of the FCC reactor 160, which is located vertically lower than a third location of injection of the third light naphtha fraction and a fourth location of injection the fourth light naphtha fraction, and vertically higher than the first location of injection of the first light naphtha fraction. The third light naphtha fraction may have a longer residence time compared to the fourth light naphtha fraction. The third light naphtha fraction may be injected in a third location of the FCC reactor 160, which is located vertically lower than a fourth location of injection of the fourth light naphtha fraction, but vertically higher than the first location and the second location.

In embodiments, the plurality of FCC naphtha fractions may comprise an FCC C5 naphtha fraction having a number of carbon atoms of 5, an FCC C6 naphtha fraction having a number of carbon atoms of 6, an FCC C7 naphtha fraction having a number of carbon atoms of 7, an FCC C8 naphtha fraction having a number of carbon atoms of 8, an FCC C9 naphtha fraction having a number of carbon atoms of 9, an FCC C10 naphtha fraction having a number of carbon atoms of 10, an FCC C11 naphtha fraction having a number of carbon atoms of 11, and an FCC C12 naphtha fraction having a number of carbon atoms of 12. In embodiments, the FCC C5 naphtha fraction, the FCC C6 naphtha fraction, and the FCC C7 naphtha fraction may be recycled back to the FCC reactor 160. The FCC C8 naphtha fraction, the FCC C9 naphtha fraction, the FCC C10 naphtha fraction, the FCC C11 naphtha fraction, and the FCC C12 naphtha fraction may not be recycled back to the FCC reactor 160. The FCC C5 naphtha fraction may have a longer residence time compared to the FCC C6 naphtha fraction and the FCC C7 naphtha fraction. The FCC C5 naphtha fraction may be injected in a first location in the FCC reactor 160, which is located vertically lower than a second location of injection of the FCC C6 naphtha fraction and a third location of injection of the FCC C7 naphtha fraction. The FCC C6 naphtha fraction may have a longer residence time compared to the FCC C7 naphtha fraction. The FCC C6 naphtha fraction may be injected in a second location of the FCC reactor 160, which is located vertically lower than a third location of injection of the FCC C7 naphtha fraction.

Figure 3:
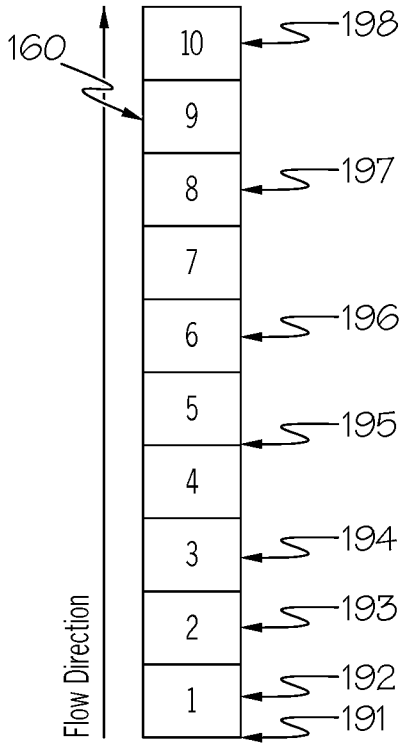
FIG. 3 schematically depicts a generalized flow diagram of a riser of the system of FIG. 2 having a plurality of FCC naphtha fractions injected at different points in the riser, according to one or more embodiments shown and described in the present disclosure.

Referring now to FIG. 3, in embodiments, the plurality of FCC naphtha fractions may comprise an FCC C5 naphtha fraction 191 having a number of carbon atoms of 5, an FCC C6 naphtha fraction 192 having a number of carbon atoms of 6, an FCC C7 naphtha fraction 193 having a number of carbon atoms of 7, an FCC C8 naphtha fraction 194 having a number of carbon atoms of 8, an FCC C9 naphtha fraction 195 having a number of carbon atoms of 9, an FCC C10 naphtha fraction 196 having a number of carbon atoms of 10, an FCC C11 naphtha fraction 197 having a number of carbon atoms of 11, and an FCC C12 naphtha fraction 198 having a number of carbon atoms of 12. As shown in FIG. 3, in embodiments, each of the FCC C5 naphtha fraction 191, the FCC C6 naphtha fraction 192, the FCC C7 naphtha fraction 193, the FCC C8 naphtha fraction 194, the FCC C9 naphtha fraction 195, the FCC C10 naphtha fraction 196, the FCC C11 naphtha fraction 197, and the FCC C12 naphtha fraction 198 may be recycled back to the FCC reactor 160. The FCC C5 naphtha fraction 191 may have a longer residence time compared to the FCC C6 naphtha fraction 192, the FCC C7 naphtha fraction 193, the FCC C8 naphtha fraction 194, the FCC C9 naphtha fraction 195, the FCC C10 naphtha fraction 196, the FCC C11 naphtha fraction 197, and the FCC C12 naphtha fraction 198. The FCC C5 naphtha fraction 191 may be injected in a first location of the FCC reactor 160 (such as riser reactor 161) that is located vertically lower than a second location of the FCC C6 naphtha fraction 192, a third location of the FCC C7 naphtha fraction 193, a fourth location of injection of the FCC C8 naphtha fraction 194, a fifth location of the FCC C9 naphtha fraction 195, a sixth location of the FCC C10 naphtha fraction 196, a seventh location of the FCC C11 naphtha fraction 197, and an eighth location of the FCC C12 naphtha fraction 198. The FCC C6 naphtha fraction 192 may have a longer residence time compared to the FCC C7 naphtha fraction 193, the FCC C8 naphtha fraction 194, the FCC C9 naphtha fraction 195, the FCC C10 naphtha fraction 196, the FCC C11 naphtha fraction 197, and the FCC C12 naphtha fraction 198 but a shorter residence time compared the FCC C5 naphtha fraction 191. The FCC C6 naphtha fraction 192 may be injected at a second location of the FCC reactor 160 that is located vertically lower than the third location of injection of the FCC C7 naphtha fraction 193, a fourth location of injection of the FCC C8 naphtha fraction 194, a fifth location of injection of the FCC C9 naphtha fraction 195, a sixth location of injection of the FCC C10 naphtha fraction 196, a seventh location of injection of the FCC C11 naphtha fraction 197, and an eighth location of injection of the FCC C12 naphtha fraction 198, and higher than the first location of injection of the FCC C5 naphtha fraction 191. The FCC C7 naphtha fraction 193 may have a longer residence time compared to the FCC C8 naphtha fraction 194, the FCC C9 naphtha fraction 195, the FCC C10 naphtha fraction 196, the FCC C11 naphtha fraction 197, and the FCC C12 naphtha fraction 198 but a shorter residence time compared the FCC C5 naphtha fraction 191, and the FCC C6 naphtha fraction 192. The FCC C7 naphtha fraction 193 may be injected in a third location of the riser 161, which is located vertically lower than a fourth location of injection of the FCC C8 naphtha fraction 194, a fifth location of injection of the FCC C9 naphtha fraction 195, a sixth location of injection of the FCC C10 naphtha fraction 196, a seventh location of injection of the FCC C11 naphtha fraction 197, and an eighth location of injection of the FCC C12 naphtha fraction 198 and higher than a first location of injection of the FCC C5 naphtha fraction 191, and a second location of injection of the FCC C6 naphtha fraction 192. The FCC C8 naphtha fraction 194 may have a longer residence time compared to the FCC C9 naphtha fraction 195, the FCC C10 naphtha fraction 196, the FCC C11 naphtha fraction 197, and the FCC C12 naphtha fraction 198 but a shorter residence time compared the FCC C5 naphtha fraction 191, the FCC C6 naphtha fraction 192, and the FCC C7 naphtha fraction 193. The FCC C8 naphtha fraction 194 may be a fourth location of injection of the riser 161, which is located vertically lower than a fifth location of injection of the FCC C9 naphtha fraction 195, a sixth location of injection of the FCC C10 naphtha fraction 196, a seventh location of injection of the FCC C11 naphtha fraction 197, and an eighth location of injection of the FCC C12 naphtha fraction 198 and higher than a first location of injection of the FCC C5 naphtha fraction 191, a second location of injection of the FCC C6 naphtha fraction 192, and a third location of injection of the FCC C7 naphtha fraction 193. The FCC C9 naphtha fraction 195 may have a longer residence time compared to the FCC C10 naphtha fraction 196, the FCC C11 naphtha fraction 197, and the FCC C12 naphtha fraction 198 but a shorter residence time compared the FCC C5 naphtha fraction 191, the FCC C6 naphtha fraction 192, the FCC C7 naphtha fraction 193, and the FCC C8 naphtha fraction 194. The FCC C9 naphtha fraction 195 may be injected in a fifth location of injection of the riser 161, which is located vertically lower than a sixth location of injection of the FCC C10 naphtha fraction 196, a seventh location of injection of the FCC C11 naphtha fraction 197, and an eighth location of injection of the FCC C12 naphtha fraction 198 and higher than a first location of injection of the FCC C5 naphtha fraction 191, a second location of injection of the FCC C6 naphtha fraction 192, a third location of injection of the FCC C7 naphtha fraction 193, and a fourth location of injection of the FCC C8 naphtha fraction 194. The FCC C10 naphtha fraction 196 may have a longer residence time compared to the FCC C11 naphtha fraction 197, and the FCC C12 naphtha fraction 198 but a shorter residence time compared the FCC C5 naphtha fraction 191, the FCC C6 naphtha fraction 192, the FCC C7 naphtha fraction 193, the FCC C8 naphtha fraction 194, and the FCC C9 naphtha fraction 195. The FCC C10 naphtha fraction 196 may be injected in a sixth location of injection of the riser 161, which is located vertically lower than a seventh location of injection of the FCC C11 naphtha fraction 197, and an eighth location of injection of the FCC C12 naphtha fraction 198 and higher than a first location of injection of the FCC C5 naphtha fraction 191, a second location of injection of the FCC C6 naphtha fraction 192, a third location of injection of the FCC C7 naphtha fraction 193, a fourth location of injection of the FCC C8 naphtha fraction 194, and a fifth location of injection of the FCC C9 naphtha fraction 195. The FCC C11 naphtha fraction 197 may have a longer residence time compared to the FCC C12 naphtha fraction 198 but a shorter residence time compared the FCC C5 naphtha fraction 191, the FCC C6 naphtha fraction 192, the FCC C7 naphtha fraction 193, the FCC C8 naphtha fraction 194, the FCC C9 naphtha fraction 195, and the FCC C10 naphtha fraction 196. The FCC C11 naphtha fraction 197 may be injected in a seventh location of injection of the riser 161, which is located vertically lower than an eighth location of injection of the FCC C12 naphtha fraction 198 and higher than a first location of injection of the FCC C5 naphtha fraction 191, a second location of injection of the FCC C6 naphtha fraction 192, a third location of injection of the FCC C7 naphtha fraction 193, a fourth location of injection of the FCC C8 naphtha fraction 194, a fifth location of injection of the FCC C9 naphtha fraction 195, and a sixth location of injection of the FCC C10 naphtha fraction 196.

Figure 4:
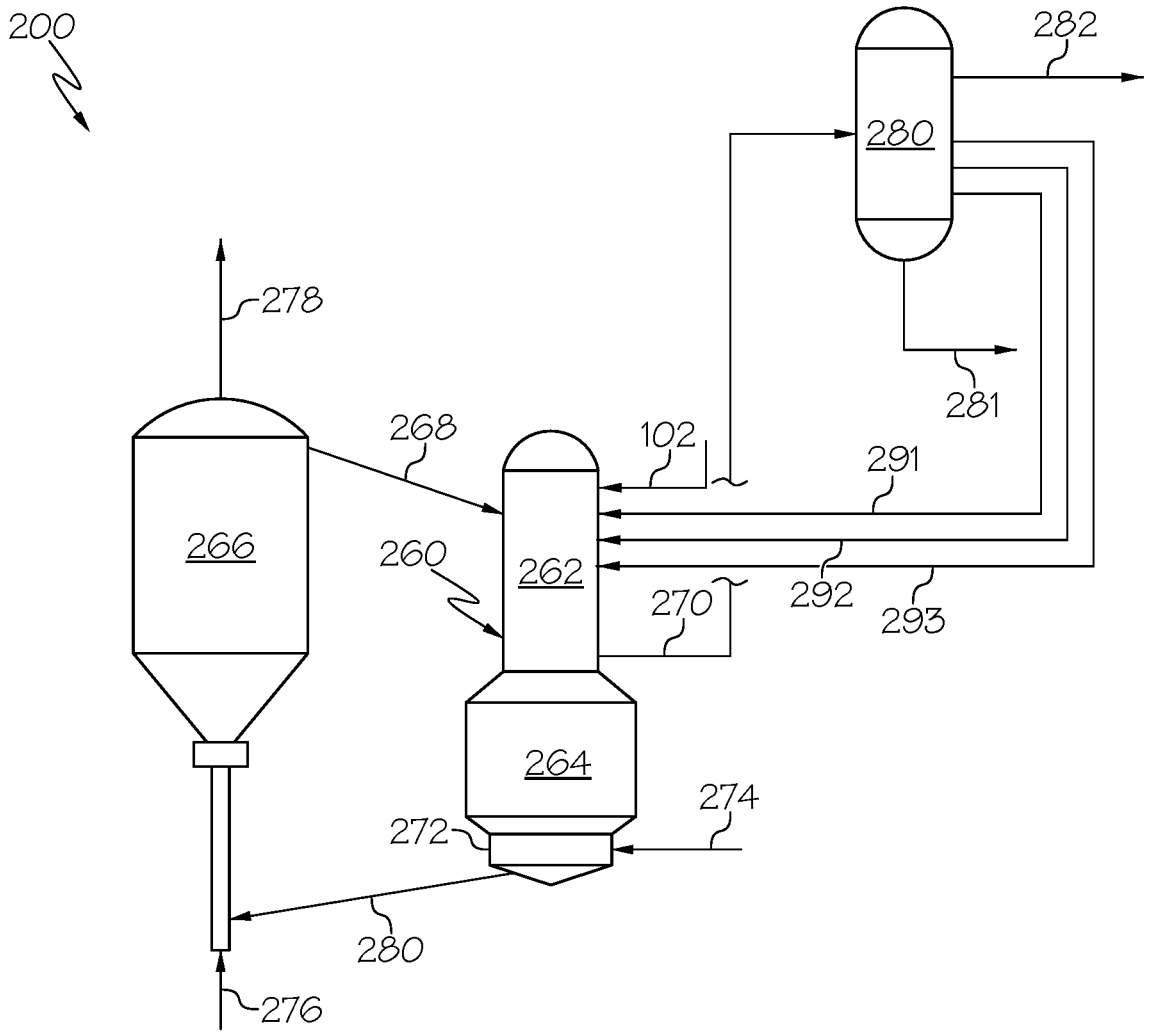
FIG. 4 schematically depicts a generalized flow diagram of another system for processing hydrocarbon feeds to produce light olefins through fluidized catalytic cracking, according to one or more embodiments shown and described in the present disclosure.

Referring now to FIG. 4, a generalized flow diagram of a system 200 comprising an FCC reactor 260 that is a downflow reactor for processing hydrocarbon feeds to produce light olefins through fluidized catalytic cracking is schematically depicted. As shown in FIG. 4, the system 200 for producing light olefins through FCC includes the FCC reactor 260. The FCC reactor 260 may comprise a downer reactor that operates under conditions that promote formation of light olefins and that minimize light olefin-consuming reactions including hydrogen-transfer reactions. A downer reactor refers to an FCC reactor in which the flow of materials pass generally vertically downward through the FCC reactor. The FCC reactor 260 may include a reactor/separator having a reaction zone 262 and a separation zone 264. The FCC reactor 260 may also include a regeneration zone 266 for regenerating the used cracking catalyst. The hydrocarbon feed 102 may be introduced to the reaction zone 262. In embodiments, the hydrocarbon feed 102 may be accompanied by steam or other suitable gas for atomization of the feed (not shown). An effective quantity of heated fresh or hot regenerated solid cracking catalyst from the regeneration zone 266 may be conveyed to the top of the reaction zone 262 through a downwardly directed a conduit or a pipe 268, commonly referred to as a transfer line or standpipe, to a withdrawal well or hopper (not shown) at the top of the reaction zone 262. The flow of hot cracking catalyst may be allowed to stabilize in order to be uniformly directed into the mixed zone or feed injection portion of the reaction zone 262. The hydrocarbon feed 102 may be injected into a mixing zone through feed injection nozzles typically situated proximate to the point of introduction of the regenerated cracking catalyst into reaction zone 262. These multiple injection nozzles result in the catalyst and oil mixing thoroughly and uniformly. Once the hydrocarbon feed 102 contacts the hot cracking catalyst, cracking reactions occur.

The reaction effluent comprising the reaction products, unreacted hydrocarbon feed, and used cracking catalyst flows through the reaction zone 262 and into the separation zone 264 at the bottom portion of FCC reactor 260. The separation zone 264 may separate the reaction effluent into the cracking effluent 270 and the used cracking catalyst. The cracking effluent 270 may include the reaction products and any unreacted hydrocarbons. The cracking effluent 270 may then be passed to the separation system 280. If necessary, for temperature control, a quench injection can be provided near the bottom of the reaction zone 262 immediately before the separation zone 264. This quench injection may quickly reduce or stop the cracking reactions and can be utilized for controlling cracking severity.

The FCC reactor 260 may further include a stripper 272 which may separate any residual hydrocarbons from the used cracking catalyst prior to transferring the used cracking catalyst to the regeneration zone 266. The used cracking catalyst from the separation zone 264 flows to the lower section of the stripper 272 that includes a catalyst stripping section into which a suitable stripping gas, such as steam, is introduced through the streamline 274. Downstream of the stripper 272, the used cracking catalyst may be transported by lift forces from the combustion air stream, which is injected through a conduit or a pipe 276, through a lift riser of the regeneration zone 266. This used cracking catalyst, which can also be contacted with additional combustion air, undergoes controlled combustion of any accumulated coke. Flue gases are removed from the regenerator through the conduit 278. In the regeneration zone 266, the heat produced from the combustion of the by-product coke is transferred to the cracking catalyst raising the temperature required to provide heat for the endothermic cracking reaction in the reaction zone 262.

Downer reactors include the introduction of feed at the top of the reactor with downward flow, shorter residence time as compared to riser reactors, and high catalyst to oil ratio, e.g., in the range of about 20:1 to about 30:1. In general, the operating conditions for the reactor of a suitable propylene production downer reactor include: a reaction temperature of from 480° C. to 800° C., from 480° C. to 650° C., from 480° C. to 620° C., or from 480° C. to 600° C., from 500° C. to 800° C., from 500° C. to 650° C., from 500° C. to 620° C., from 500° C. to 600° C., or from 500° C. to 550° C.; a reaction pressure of from 1 kg/cm$^2$ (98.07 kPa) to 20 kg/cm$^2$ (1961.33 kPa), from 1 kg/cm$^2$ (98.07 kPa) to 10 kg/cm$^2$ (980.67 kPa), or from 1 kg/cm$^2$ (98.07 kPa) to 3 kg/cm$^2$ (294.2 kPa); a contact time (in the reactor) of from 0.1 seconds to 60 seconds, from 1 second to 50 seconds, from 10 second to 40 seconds, from 20 second to 60 seconds, or from 20 second to 40 seconds; and a catalyst to hydrocarbon feed ratio of from 1:1 to 40:1, from 1:1 to 20:1, from 1:1 to 10:1, or from 3:1 to 6:1.

Referring still to FIG. 4, the cracking effluent 270 may be separated in the cracking effluent separation system 280 to produce the cycle oil stream 281, the light olefin effluent 282 and a plurality of FCC naphtha fractions. The light olefin effluent 282 may comprise ethylene, propylene, butenes, or combinations thereof. In embodiments, the light olefin effluent 282 may comprise propylene. In embodiments, the FCC naphtha fractions may include the first light naphtha fraction 291, the second light naphtha fraction 292, and the third light naphtha fraction 293, as shown in FIG. 4. Though not shown in FIG. 4, it is understood that the FCC naphtha fractions may include any of the other FCC naphtha fractions previously discussed in the present application, such as but not limited the middle naphtha fraction, the heavy naphtha fraction, or any of the naphtha fractions having specific numbers or carbon atoms or boiling point ranges. The cycle oil stream 281 may include constituents of the cracking effluent 270 having boiling point temperatures greater than 220° C., and may include light cycle oil (LCO), heavy cycle oil (HCO), or combinations of these.

At least two of the plurality of FCC naphtha fractions may be recycled back to the downer reactor 262. In embodiments, the FCC naphtha fractions recycled back to the downer reactor 262 may comprise a first light naphtha fraction 291 having a first reactivity, a second light naphtha fraction 292 having a second reactivity, and a third light naphtha fraction 293 having a third reactivity, where the third reactivity is higher than the second reactivity, and the second reactivity is higher than the first reactivity. The first light naphtha fraction 291 may be injected at a first location of the downer reactor 262. The second light naphtha fraction 292 may be injected in a second location of the downer reactor 262. The third light naphtha fraction 293 may be injected at a third location of the downer reactor 262. The third location may be located vertically lower than the first location. The second location may be located vertically lower than the first location. The second location may be between the first location and the third location. In other words, the second location may be upstream of the first location, and the third location may be upstream of the second location. The first light naphtha fraction 291 may have a first residence time in the FCC reactor 260, the second light naphtha fraction 292 may have a second residence time in the FCC reactor 260, and the third light naphtha fraction 293 may have a third residence time in the FCC reactor 260, where the first residence time is longer than the second residence time, and the second residence time is longer than the third residence time.

In embodiments, the plurality of FCC naphtha fractions recycled back to the downer reactor 262 may comprise a first light naphtha fraction having a boiling point temperature range of from 20° C. to 50° C., from 27° C. to 50° C., or from 36° C. to 50° C., a second light naphtha fraction having a boiling point temperature range of from 50° C. to 75° C., a third light naphtha fraction having a boiling point temperature range of from 75° C. to 100° C., and the first light naphtha fraction may have a longer residence time in the downer reactor 262 compared to the second light naphtha fraction and the third light naphtha fraction. The first light naphtha fraction may be injected in a first location of the FCC reactor 260, where the first location is located vertically higher than a second location of the second light naphtha fraction and a third location of the third light naphtha fraction. The second light naphtha fraction may have a longer residence time compared to the third light naphtha fraction, but longer residence time compared to the first light naphtha fraction. The second light naphtha fraction may be injected in a second location of the FCC reactor 260, which is located vertically higher than a third location of the third light naphtha fraction, but lower than the first location of the first light naphtha fraction. In embodiments, the first location of injection of the first light naphtha fraction may be upstream of the second location of injection of the second light naphtha fraction, and the second location of injection of the second light naphtha fraction may be upstream of the third location of injection of the third light naphtha fraction.

In embodiments, the FCC naphtha fractions recycled back to the downer reactor 262 may comprise a first light naphtha fraction having a number of carbon atoms of 5 and 6, a second light naphtha fraction having a number of carbon atoms of 7 and 8, a third light naphtha fraction having a number of carbon atoms of 9 and 10, and a fourth light naphtha fraction having a number of carbon atoms of 11 and 12, and the first light naphtha fraction may have a longer residence time compared to the second light naphtha fraction, the third light naphtha fraction, and the fourth light naphtha fraction. The first light naphtha fraction may be injected in a first location of the FCC reactor 260, which is located vertically higher than a second location of injection of the second light naphtha fraction, a third location of injection of the third light naphtha fraction, and a fourth location of injection of the fourth light naphtha fraction. The second light naphtha fraction may have a longer residence time compared to the third light naphtha fraction, and the fourth light naphtha fraction, but longer than the first light naphtha fraction. The second light naphtha fraction may be injected at a second location of the FCC reactor 260, which is located vertically higher than a third location of injection of the third light naphtha fraction and a fourth location of injection the fourth light naphtha fraction, and vertically lower than the first location of injection of the first light naphtha fraction. The third light naphtha fraction may have a longer residence time compared to the fourth light naphtha fraction. The third light naphtha fraction may be injected in a third location of the FCC reactor 260, which is located vertically higher than a fourth location of injection of the fourth light naphtha fraction, but vertically lower than the first location and the second location.

In embodiments, the plurality of FCC naphtha fractions may comprise an FCC C5 naphtha fraction having a number of carbon atoms of 5, an FCC C6 naphtha fraction having a number of carbon atoms of 6, an FCC C7 naphtha fraction having a number of carbon atoms of 7, an FCC C8 naphtha fraction having a number of carbon atoms of 8, an FCC C9 naphtha fraction having a number of carbon atoms of 9, an FCC C10 naphtha fraction having a number of carbon atoms of 10, an FCC C11 naphtha fraction having a number of carbon atoms of 11, and an FCC C12 naphtha fraction having a number of carbon atoms of 12. In embodiments, the FCC C5 naphtha fraction, the FCC C6 naphtha fraction, and the FCC C7 naphtha fraction may be recycled back to the FCC reactor 260. The FCC C8 naphtha fraction, the FCC C9 naphtha fraction, the FCC C10 naphtha fraction, the FCC C11 naphtha fraction, and the FCC C12 naphtha fraction may not be recycled back to the FCC reactor 260. The FCC C5 naphtha fraction may have a longer residence time compared to the FCC C6 naphtha fraction and the FCC C7 naphtha fraction. The FCC C5 naphtha fraction may be injected in a first location in the FCC reactor 260, which is located vertically higher than a second location of injection of the FCC C6 naphtha fraction and a third location of injection of the FCC C7 naphtha fraction. The FCC C6 naphtha fraction may have a longer residence time compared to the FCC C7 naphtha fraction. The FCC C6 naphtha fraction may be injected in a second location of the FCC reactor 260, which is located vertically higher than a third location of injection of the FCC C7 naphtha fraction.

Figure 5:
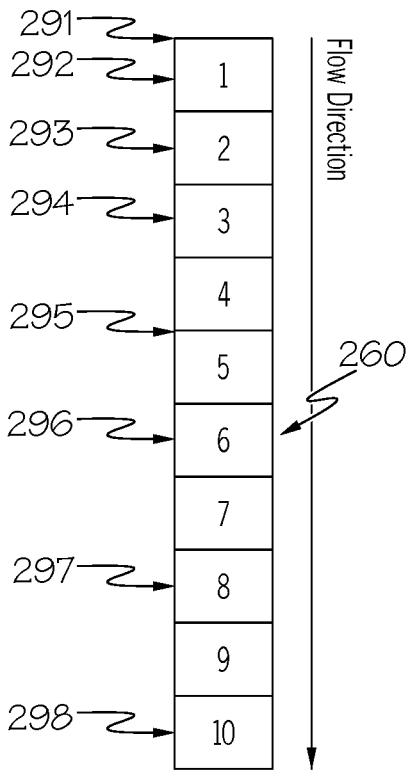
FIG. 5 schematically depicts a generalized flow diagram of a reaction zone of an FCC reactor of the system of FIG. 4, where the FCC reactor is a down flow FCC reactor, according to one or more embodiments shown and described in the present disclosure.

Referring now to FIG. 5, in embodiments, the plurality of FCC naphtha fractions may comprise an FCC C5 naphtha fraction 291 having a number of carbon atoms of 5, an FCC C6 naphtha fraction 292 having a number of carbon atoms of 6, an FCC C7 naphtha fraction 293 having a number of carbon atoms of 7, an FCC C8 naphtha fraction 294 having a number of carbon atoms of 8, an FCC C9 naphtha fraction 295 having a number of carbon atoms of 9, an FCC C10 naphtha fraction 296 having a number of carbon atoms of 10, an FCC C11 naphtha fraction 297 having a number of carbon atoms of 11, and an FCC C12 naphtha fraction 298 having a number of carbon atoms of 12. As shown in FIG. 5, in embodiments, each of the FCC C5 naphtha fraction 291, the FCC C6 naphtha fraction 292, the FCC C7 naphtha fraction 293, the FCC C8 naphtha fraction 294, the FCC C9 naphtha fraction 295, the FCC C10 naphtha fraction 296, the FCC C11 naphtha fraction 297, and the FCC C12 naphtha fraction 298 may be recycled back to the FCC reactor 260. The FCC C5 naphtha fraction 291 may have a longer residence time compared to the FCC C6 naphtha fraction 292, the FCC C7 naphtha fraction 293, the FCC C8 naphtha fraction 294, the FCC C9 naphtha fraction 295, the FCC C10 naphtha fraction 296, the FCC C11 naphtha fraction 297, and the FCC C12 naphtha fraction 298. The FCC C5 naphtha fraction 291 may be injected in a first location of the FCC reactor 260 (such as downer reactor 262) that is located vertically higher than a second location of the FCC C6 naphtha fraction 292, a third location of the FCC C7 naphtha fraction 293, a fourth location of injection of the FCC C8 naphtha fraction 294, a fifth location of the FCC C9 naphtha fraction 295, a sixth location of the FCC C10 naphtha fraction 296, a seventh location of the FCC C11 naphtha fraction 297, and an eighth location of the FCC C12 naphtha fraction 298. The FCC C6 naphtha fraction 292 may have a longer residence time compared to the FCC C7 naphtha fraction 293, the FCC C8 naphtha fraction 294, the FCC C9 naphtha fraction 295, the FCC C10 naphtha fraction 296, the FCC C11 naphtha fraction 297, and the FCC C12 naphtha fraction 298 but a shorter residence time compared the FCC C5 naphtha fraction 291. The FCC C6 naphtha fraction 292 may be injected at a second location of the FCC reactor 260 that is located vertically higher than the third location of injection of the FCC C7 naphtha fraction 293, a fourth location of injection of the FCC C8 naphtha fraction 294, a fifth location of injection of the FCC C9 naphtha fraction 295, a sixth location of injection of the FCC C10 naphtha fraction 296, a seventh location of injection of the FCC C11 naphtha fraction 297, and an eighth location of injection of the FCC C12 naphtha fraction 298, and lower than the first location of injection of the FCC C5 naphtha fraction 291. The FCC C7 naphtha fraction 293 may have a longer residence time compared to the FCC C8 naphtha fraction 294, the FCC C9 naphtha fraction 295, the FCC C10 naphtha fraction 296, the FCC C11 naphtha fraction 297, and the FCC C12 naphtha fraction 298 but a shorter residence time compared the FCC C5 naphtha fraction 291, and the FCC C6 naphtha fraction 292. The FCC C7 naphtha fraction 293 may be injected in a third location of the downer 261, which is located vertically higher than a fourth location of injection of the FCC C8 naphtha fraction 294, a fifth location of injection of the FCC C9 naphtha fraction 295, a sixth location of injection of the FCC C10 naphtha fraction 296, a seventh location of injection of the FCC C11 naphtha fraction 297, and an eighth location of injection of the FCC C12 naphtha fraction 298 and lower than a first location of injection of the FCC C5 naphtha fraction 291, and a second location of injection of the FCC C6 naphtha fraction 292. The FCC C8 naphtha fraction 294 may have a longer residence time compared to the FCC C9 naphtha fraction 295, the FCC C10 naphtha fraction 296, the FCC C11 naphtha fraction 297, and the FCC C12 naphtha fraction 298 but a shorter residence time compared the FCC C5 naphtha fraction 291, the FCC C6 naphtha fraction 292, and the FCC C7 naphtha fraction 293. The FCC C8 naphtha fraction 294 may be a fourth location of injection of the downer 261, which is located vertically higher than a fifth location of injection of the FCC C9 naphtha fraction 295, a sixth location of injection of the FCC C10 naphtha fraction 296, a seventh location of injection of the FCC C11 naphtha fraction 297, and an eighth location of injection of the FCC C12 naphtha fraction 298 and lower than a first location of injection of the FCC C5 naphtha fraction 291, a second location of injection of the FCC C6 naphtha fraction 292, and a third location of injection of the FCC C7 naphtha fraction 293. The FCC C9 naphtha fraction 295 may have a longer residence time compared to the FCC C10 naphtha fraction 296, the FCC C11 naphtha fraction 297, and the FCC C12 naphtha fraction 298 but a shorter residence time compared the FCC C5 naphtha fraction 291, the FCC C6 naphtha fraction 292, the FCC C7 naphtha fraction 293, and the FCC C8 naphtha fraction 294. The FCC C9 naphtha fraction 295 may be injected in a fifth location of injection of the downer 261, which is located vertically higher than a sixth location of injection of the FCC C10 naphtha fraction 296, a seventh location of injection of the FCC C11 naphtha fraction 297, and an eighth location of injection of the FCC C12 naphtha fraction 298 and lower than a first location of injection of the FCC C5 naphtha fraction 291, a second location of injection of the FCC C6 naphtha fraction 292, a third location of injection of the FCC C7 naphtha fraction 293, and a fourth location of injection of the FCC C8 naphtha fraction 294. The FCC C10 naphtha fraction 296 may have a longer residence time compared to the FCC C11 naphtha fraction 297, and the FCC C12 naphtha fraction 298 but a shorter residence time compared the FCC C5 naphtha fraction 291, the FCC C6 naphtha fraction 292, the FCC C7 naphtha fraction 293, the FCC C8 naphtha fraction 294, and the FCC C9 naphtha fraction 295. The FCC C10 naphtha fraction 296 may be injected in a sixth location of injection of the downer 261, which is located vertically higher than a seventh location of injection of the FCC C11 naphtha fraction 297, and an eighth location of injection of the FCC C12 naphtha fraction 298 and lower than a first location of injection of the FCC C5 naphtha fraction 291, a second location of injection of the FCC C6 naphtha fraction 292, a third location of injection of the FCC C7 naphtha fraction 293, a fourth location of injection of the FCC C8 naphtha fraction 294, and a fifth location of injection of the FCC C9 naphtha fraction 295. The FCC C11 naphtha fraction 297 may have a longer residence time compared to the FCC C12 naphtha fraction 298 but a shorter residence time compared the FCC C5 naphtha fraction 291, the FCC C6 naphtha fraction 292, the FCC C7 naphtha fraction 293, the FCC C8 naphtha fraction 294, the FCC C9 naphtha fraction 295, and the FCC C10 naphtha fraction 296. The FCC C11 naphtha fraction 297 may be injected in a seventh location of injection of the downer 261, which is located vertically higher than an eighth location of injection of the FCC C12 naphtha fraction 298 and lower than a first location of injection of the FCC C5 naphtha fraction 291, a second location of injection of the FCC C6 naphtha fraction 292, a third location of injection of the FCC C7 naphtha fraction 293, a fourth location of injection of the FCC C8 naphtha fraction 294, a fifth location of injection of the FCC C9 naphtha fraction 295, and a sixth location of injection of the FCC C10 naphtha fraction 296.

EXAMPLES

The following example illustrates features of the present disclosure but is not intended to limit the scope of the disclosure.

Comparative Examples 1-4

For Comparative Examples 1-4, the hydrocarbon feed having properties and compositions shown in the above Table 2 was fluid catalytically cracked in an ACE unit. The ACE unit is described more in detail in U.S. Pat. No. 6,069,012 and in D7964/D7964M-19 entitled "Standard Test Method For Determining Activity Of Fluid Catalytic Cracking (FCC) Catalysts In A Fluidized Bed"; ASTM International. Comparative Examples 1~4 were conducted at a temperature of 520° C., a residence time of 30 seconds, and a catalyst to oil ratio in the range 3-6 respectively. The same FCC catalyst was used for Comparative Examples 1~4 and 6-9 and Examples 10-13. The operating conditions and product yields for Comparative Examples 1~4 are summarized in Table 3.

TABLE 3

| Overall yields without naphtha recycle | Comparative Example 1 | Comparative Example 2 | Comparative Example 3 | Comparative Example 4 |
|---|---|---|---|---|
| CAT/OIL (wt/wt) | 3 | 4 | 5 | 6 |
| Temperature, ° C. | 520.0 | 520.0 | 520.0 | 520.0 |
| Residence time, sec. | 30.0 | 30.0 | 30.0 | 30.0 |
| Conversion | 88.0 | 89.6 | 90.4 | 91.0 |
| Yields (wt %) | | | | |
| Hydrogen | 0.1 | 0.1 | 0.1 | 0.1 |
| Methane | 0.2 | 0.2 | 0.3 | 0.3 |
| Ethane | 0.2 | 0.2 | 0.2 | 0.2 |
| Ethylene | 1.8 | 1.9 | 2.0 | 2.0 |
| Propane | 2.2 | 2.2 | 2.2 | 2.2 |
| Propylene | 15.0 | 15.5 | 15.7 | 16.1 |
| Isobutane | 7.0 | 7.1 | 7.2 | 7.1 |
| n-Butane | 1.4 | 1.4 | 1.4 | 1.4 |
| 1-Butene | 10.3 | 10.3 | 10.3 | 10.2 |
| Isobutylene | 6.6 | 6.6 | 6.5 | 6.5 |
| Light Naphtha 1 (20-50° C.) | 3.9 | 4.0 | 4.0 | 4.1 |
| Light Naphtha 2 (50-75° C.) | 5.6 | 5.7 | 5.8 | 5.8 |
| Light Naphtha 3 (75-100° C.) | 8.4 | 8.6 | 8.6 | 8.8 |
| Mid Naphtha (100-160° C.) | 16.8 | 17.2 | 17.3 | 17.5 |
| Heavy Naphtha (160-220° C.) | 7.4 | 7.1 | 7.2 | 6.9 |
| LCO (220-360° C.) | 8.4 | 7.4 | 7.0 | 6.6 |
| HCO (360° C.+) | 3.7 | 3.0 | 2.6 | 2.4 |
| Coke yield | 1.3 | 1.5 | 1.7 | 1.9 |
| wt% recovery | 100.0 | 100.0 | 100.0 | 99.9 |

Example 5

In Example 5, reaction kinetics of individual fractions in the FCC reactor were evaluated. Based on the residence time requirements, the locations of injection points of the FCC reactor were determined. The reaction kinetics of the individual fractions are modeled using an in-house developed model, which is based on first principles and empirical data, for cracking of individual hydrocarbon fractions. In particular, the cracking data for each hydrocarbon fraction (i.e., C5, C6, and C7) are modeled using first order kinetics and the estimations are made from this model. Table 4 shows the cracking kinetics of olefins with carbon number in the range 5-7. As shown in Table 4, the rate constants are first calculated at each residence time using the basic 1 st order kinetic equation for each carbon number. The catalyst deactivation is not incorporated into the rate equation; therefore the rate constants vary at each residence time due to different coke level on the catalysts. The conversion kinetics was calculated and plotted against the yield. Then conversions were calculated and then reactivity ratios were determined from the rate conversion data.

The reactivity ratio determines at which location the fraction should be added. Table 4 shows that the light naphtha fraction having a carbon number of 5 requires a longer residence time in the FCC reactor compared to the light naphtha fraction having a carbon number of 6 and the light naphtha fraction having a carbon number of 7. The light naphtha fraction having a carbon number of 6 requires a longer residence time in the FCC reactor compared to the light naphtha fraction having a carbon number of 7 but a shorter residence time compared to the light naphtha fraction having a carbon number of 5.

TABLE 4

| Kinetic data | | | | | | | | |
|---|---|---|---|---|---|---|---|---|
| Residence Time | Rate Constants at 520° C., (seconds$^{-1}$) | | | Conversions at 520° C., wt % | | | Reactivity ratio | |
| (seconds) | C5 | C6 | C7 | C5 | C6 | C7 | C6/C5 | C7/C5 |
| 5 | 0.0529 | 0.1002 | 0.1552 | 23.24 | 39.40 | 53.98 | 1.70 | 2.32 |
| 10 | 0.0291 | 0.0555 | 0.0870 | 25.23 | 42.60 | 58.09 | 1.69 | 2.30 |
| 15 | 0.0210 | 0.0409 | 0.0648 | 27.02 | 45.86 | 62.19 | 1.70 | 2.30 |
| 20 | 0.0169 | 0.0338 | 0.0543 | 28.62 | 49.17 | 66.22 | 1.72 | 2.31 |
| 25 | 0.0143 | 0.0298 | 0.0483 | 30.07 | 52.49 | 70.12 | 1.75 | 2.33 |
| 30 | 0.0126 | 0.0272 | 0.0447 | 31.40 | 55.78 | 73.85 | 1.78 | 2.35 |
| 40 | 0.0103 | 0.0243 | 0.0410 | 33.81 | 62.19 | 80.58 | 1.84 | 2.38 |
| 50 | 0.0089 | 0.0229 | 0.0395 | 36.02 | 68.19 | 86.11 | 1.89 | 2.39 |
| 60 | 0.0080 | 0.0222 | 0.0391 | 38.23 | 73.63 | 90.43 | 1.93 | 2.37 |
| 70 | 0.0074 | 0.0219 | 0.0395 | 40.59 | 78.41 | 93.68 | 1.93 | 2.31 |
| 80 | 0.0071 | 0.0218 | 0.0403 | 43.26 | 82.45 | 96.02 | 1.91 | 2.22 |
| 90 | 0.0069 | 0.0216 | 0.0413 | 46.36 | 85.74 | 97.58 | 1.85 | 2.10 |
| 100 | 0.0069 | 0.0215 | 0.0421 | 49.99 | 88.33 | 98.52 | 1.77 | 1.97 |

Comparative Examples 6-9

In Comparative Examples 6-9, fluid catalytic cracking of the hydrocarbon feed having properties and compositions shown in Table 2 is modeled with recycling of the light naphtha back to the inlet of the fluidized catalyst cracking reactor. The light naphtha recycled back to the inlet includes the light naphtha 1 having a boiling point of from 20° C. to 50° C. (e.g., C5 hydrocarbons), the light naphtha 2 having a boiling point of 50° C. to 75° C. (e.g., C6 hydrocarbons), and the light naphtha 3 having a boiling point of 75° C. to 100° C. (e.g., C7 hydrocarbons). The light naphtha 1, light naphtha 2, and light naphtha 3 are all combined with the hydrocarbon feed and then recycled back into the FCC reactor at the inlet of the FCC reactor.

Comparative Examples 6-9 are modeled at a temperature of 520° C., a residence time of 30 seconds, and at a catalyst to oil ratio in the range 3-6 respectively. Comparative Examples 6-9 are modeled using the data from Table 4 for the conversion of the incoming hydrocarbon feed and adding the conversion of the light naphtha recycled back to the inlet. The conversion of the light naphtha recycled back to the inlet is modeled using the reaction kinetics and conversion data from Table 5 for C5, C6, and C7 hydrocarbons at a residence time of 30 seconds. The modeling assumes no effects from comingling or interactions between the recycled naphtha fractions and the hydrocarbon feed. The operating conditions and product yields for Comparative Examples 6-9 are summarized in Table 5.

TABLE 5

| Yields with naphtha recycle whole naphtha | Comparative Example 6 | Comparative Example 7 | Comparative Example 8 | Comparative Example 9 |
|---|---|---|---|---|
| CAT/OIL (wt/wt) | 3 | 4 | 5 | 6 |
| Temperature, ° C. | 520.0 | 520.0 | 520.0 | 520.0 |
| Residence time, sec. | 30.0 | 30.0 | 30.0 | 30.0 |
| Conversion | 88.0 | 89.6 | 90.4 | 91.0 |
| Yields (wt %) | | | | |
| Hydrogen | 0.1 | 0.1 | 0.1 | 0.1 |
| Methane | 0.2 | 0.2 | 0.3 | 0.3 |
| Ethane | 0.2 | 0.2 | 0.2 | 0.2 |
| Ethylene | 2.1 | 2.2 | 2.3 | 2.4 |

TABLE 5-continued

| Yields with naphtha recycle whole naphtha | | | | |
|---|---|---|---|---|
| | Comparative Example 6 | Comparative Example 7 | Comparative Example 8 | Comparative Example 9 |
| Propane | 2.2 | 2.2 | 2.2 | 2.2 |
| Propylene | 16.6 | 17.2 | 17.4 | 17.9 |
| Isobutane | 7.0 | 7.1 | 7.2 | 7.1 |
| n-Butane | 1.4 | 1.4 | 1.4 | 1.4 |
| 1-Butene | 12.4 | 12.5 | 12.5 | 12.5 |
| Isobutylene | 6.6 | 6.6 | 6.5 | 6.5 |
| Light Naphtha 1 (20-50° C.) | 5.4 | 5.4 | 5.4 | 5.5 |
| Light Naphtha 2 (50-75° C.) | 3.9 | 4.0 | 4.0 | 4.0 |
| Light Naphtha 3 (75-100° C.) | 3.8 | 3.9 | 3.9 | 4.0 |
| Mid Naphtha (100-160° C.) | 16.8 | 17.2 | 17.3 | 17.5 |
| Heavy Naphtha (160-220° C.) | 7.4 | 7.1 | 7.2 | 6.9 |
| LCO (220-360° C.) | 8.4 | 7.4 | 7.0 | 6.6 |
| HCO (360° C.+) | 3.7 | 3.0 | 2.6 | 2.4 |
| Coke yield | 1.3 | 1.5 | 1.7 | 1.9 |
| wt % recovery | 99.3 | 99.3 | 99.3 | 99.2 |

Examples 10-13

For Examples 10-13, fluidized catalytic cracking of the hydrocarbon feed having properties and compositions shown in Table 2 is modeled with recycle of the light naphtha fractions back to different locations within the FCC reactor. The light naphtha 1 having a boiling point of from 20° C. to 50° C., the light naphtha 2 having a boiling point of 50° C. to 75° C., and the light naphtha 3 having a boiling point of 75° C. to 100° C. are separated from the cracking effluent. All three naphtha fractions are recycled back to the reactor based on their reactivity. The light naphtha 1 is fed at the inlet of the reactor with the hydrocarbon feed. The light naphtha 2 is injected at the point in the reactor resulting in a residence time of the light naphtha 2 of 15 seconds. The light naphtha 3 is injected at the location in the reactor resulting in a residence time of 5 seconds. The modeling of the conversion and yields for Examples 10-13 is the same as for Comparative Example 6-9 with the exception of using the reaction kinetics and conversions corresponding to the residence time for each of the light naphtha fractions based on the injection location of the light naphtha fractions. Examples 10-13 are modeled using the data from Table 4 for the conversion of the incoming hydrocarbon feed at each catalyst to oil ratio, calculating the estimated conversion and yields for each light naphtha fraction at each residence time based on the reaction kinetics and conversion data in Table 5, and then adding the conversions and yield of each of the naphtha fractions to the conversion and yield of the hydrocarbon feed from Table 4. The conversion of the light naphtha recycled back to the inlet is modeled using the reaction kinetics and conversion data from Table 5 for light naphtha 1 (e.g., C5 hydrocarbons) at a residence time of 30 seconds, light naphtha 2 (e.g., C6 hydrocarbons) at the residence time of 15 seconds, and light naphtha 3 (e.g., C7 hydrocarbons) at a residence time of 5 seconds. The modeling assumes no effects from commingling or interactions between the recycled naphtha fractions and the hydrocarbon feed. The operating conditions and product yields are summarized in Table 6.

TABLE 6

| Overall yields with naphtha recycle | | | | |
|---|---|---|---|---|
| | Example 10 | Example 11 | Example 12 | Example 13 |
| CAT/OIL (wt/wt) | 3 | 4 | 5 | 6 |
| Temperature, ° C. | 520.0 | 520.0 | 520.0 | 520.0 |
| Residence time, sec. | 30.0 | 30.0 | 30.0 | 30.0 |
| Conversion | 88.0 | 89.6 | 90.4 | 91.0 |
| Yields (wt %) | | | | |
| Hydrogen | 0.1 | 0.1 | 0.1 | 0.1 |
| Methane | 0.2 | 0.2 | 0.3 | 0.3 |
| Ethane | 0.2 | 0.2 | 0.2 | 0.2 |
| Ethylene | 2.0 | 2.1 | 2.2 | 2.2 |
| Propane | 2.2 | 2.2 | 2.2 | 2.2 |
| Propylene | 18.3 | 18.9 | 19.1 | 19.6 |
| Isobutane | 7.0 | 7.1 | 7.2 | 7.1 |
| n-Butane | 1.4 | 1.4 | 1.4 | 1.4 |
| 1-Butene | 13.6 | 13.7 | 13.7 | 13.7 |
| Isobutylene | 6.6 | 6.6 | 6.5 | 6.5 |
| Light Naphtha 1 (20-50° C.) | 2.9 | 3.0 | 3.0 | 3.0 |
| Light Naphtha 2 (50-75° C.) | 3.9 | 4.0 | 4.0 | 4.0 |
| Light Naphtha 3 (75-100° C.) | 3.8 | 3.9 | 3.9 | 4.0 |
| Mid Naphtha (100-160° C.) | 16.8 | 17.2 | 17.3 | 17.5 |
| Heavy Naphtha (160-220° C.) | 7.4 | 7.1 | 7.2 | 6.9 |
| LCO (220-360° C.) | 8.4 | 7.4 | 7.0 | 6.6 |
| HCO (360° C.+) | 3.7 | 3.0 | 2.6 | 2.4 |
| Coke yield | 1.3 | 1.5 | 1.7 | 1.9 |
| wt % recovery | 99.6 | 99.6 | 99.6 | 99.5 |

As shown in Tables 3 and 6, Examples 10-13 showed a yield of ethylene of from 2.0 wt. % to 2.2 wt. %, which is greater than or equal to the yield of ethylene of Comparative Examples 1-4. Examples 10-13 showed a yield of propylene of from 18.3 wt. % to 19.6 wt. %, which is greater than the yield of propylene of Comparative Examples 1-4. Examples 10-13 showed a yield of butene of from 13.6 wt. % to 13.7 wt. %, which is greater than the yield of butene of Comparative Examples 1-4. Examples 10-13 showed the yield of ethylene, propylene, and butenes greater than the yield of ethylene, propylene, and butenes of Comparative Examples 1-4.

As shown in Tables 5 and 6, Examples 10-13 showed a yield of propylene of from 18.3 wt. % to 19.6 wt. %, which is greater than the yield of propylene of Comparative Examples 6-9. Examples 10-13 showed a yield of butene of from 13.6 wt. % to 13.7 wt. %, which is greater than the yield of butene of Comparative Examples 6-9. Examples 10-13 showed the yield of ethylene, propylene, and butenes greater than the yield of ethylene, propylene, and butenes of Comparative Examples 6-9.

A first aspect of the present disclosure may be directed to a process for producing light olefins through fluidized catalytic cracking (FCC), the process comprising: contacting a hydrocarbon feed with an FCC catalyst in an FCC reactor at reaction conditions that cause at least a portion of hydrocarbons from the hydrocarbon feed to undergo catalytic cracking reactions to a cracking effluent comprising the light olefins, where the light olefins comprise ethylene, propylene, butenes, or combinations of these; separating the cracking effluent in a cracking effluent separation system to produce a light olefin effluent and a plurality of FCC naphtha fractions, where: the light olefin effluent comprises propylene, butenes, or combinations thereof, each of the plurality of FCC naphtha fraction has a different boiling point temperature range; and the constituents of all of the plurality of FCC naphtha fractions have a number of carbon atoms between 5 and 12; recycling at least two of the FCC naphtha fractions back to the FCC reactor; and injecting each of the FCC naphtha fractions at a different location within the FCC reactor based on reactivity of each of the at least two of the plurality of FCC naphtha.

A second aspect of the present disclosure may include the first aspect, where: the FCC reactor comprises a riser reactor, the plurality of FCC naphtha fractions comprise a first light naphtha fraction having a first reactivity and a second light naphtha fraction having a second reactivity, where the second reactivity is higher than the first reactivity, the first light naphtha fraction is injected in a first location of the riser reactor, and the second light naphtha fraction is injected in a second location of the riser reactor, where the second location is located vertically higher than the first location.

A third aspect of the present disclosure may include either one of the first or second aspects, where: the FCC reactor is a downer reactor, the plurality of FCC naphtha fractions comprise a first light naphtha fraction having a first reactivity and a second light naphtha fraction having a second reactivity, the second reactivity is higher than the first reactivity, the first light naphtha fraction is injected in a first location of the downer reactor, and the second light naphtha fraction is injected in a second location of the riser reactor, where the second location is located vertically lower than the first location.

A fourth aspect of the present disclosure may include any one of the first through third aspects, where the plurality of FCC naphtha fractions comprise a first light naphtha fraction having a boiling point temperature range of from 20 Celsius (C) to 50° C., a second light naphtha fraction having a boiling point temperature range of from 50° C. to 75° C., a third light naphtha fraction having a boiling point temperature range of from 75° C. to 100° C., a middle naphtha fraction having a boiling point temperature range of from 100° C. to 160° C., and a heavy naphtha fraction having a boiling point temperature range of from 160° C. to 220° C.

A fifth aspect of the present disclosure may include any one of the first through fourth aspects, where the plurality of FCC naphtha fractions comprises a first light naphtha fraction having a boiling point of from 20° C. to 50° C., a second light naphtha fraction having a boiling point of from 50° C. to 75° C., and a third light naphtha fraction having a boiling point of from 75° C. to 100° C.

A sixth aspect of the present disclosure may include any one of the first through fifth aspects, where the plurality of FCC naphtha fractions comprises a first light naphtha fraction having a number of carbon atoms of 5 and 6, a second light naphtha fraction having a number of carbon atoms of 7 and 8, a third light naphtha fraction having a number of carbon atoms of 9 and 10, and a fourth light naphtha fraction having a number of carbon atoms of 11 and 12.

A seventh aspect of the present disclosure may include any one of the first through sixth aspects, where the plurality of FCC naphtha fractions comprises an FCC C5 naphtha fraction having a number of carbon atoms of 5, an FCC C6 naphtha fraction having a number of carbon atoms of 6, an FCC C7 naphtha fraction having a number of carbon atoms of 7, an FCC C8 naphtha fraction having a number of carbon atoms of 8, an FCC C9 naphtha fraction having a number of carbon atoms of 9, an FCC C10 naphtha fraction having a number of carbon atoms of 10, an FCC C11 naphtha fraction having a number of carbon atoms of 11, and an FCC C12 naphtha fraction having a number of carbon atoms of 12.

An eighth aspect of the present disclosure may include any one of the first through seventh aspects, where: the plurality of FCC naphtha fractions comprises an FCC C5 naphtha fraction having a number of carbon atoms of 5, an FCC C6 naphtha fraction having a number of carbon atoms of 6, an FCC C7 naphtha fraction having a number of carbon atoms of 7, an FCC C8 naphtha fraction having a number of carbon atoms of 8, an FCC C9 naphtha fraction having a number of carbon atoms of 9, an FCC C10 naphtha fraction having a number of carbon atoms of 10, an FCC C11 naphtha fraction having a number of carbon atoms of 11, and an FCC C12 naphtha fraction having a number of carbon atoms of 12, and the FCC C5 naphtha fraction, the FCC C6 naphtha fraction, and the FCC C7 naphtha fraction are recycled back to the FCC reactor.

A ninth aspect of the present disclosure may include any one of the first through eighth aspects, where: the plurality of FCC naphtha fractions comprise a first light naphtha fraction having a first reactivity, a second light naphtha fraction having a second reactivity, and a third light naphtha fraction having a third reactivity, the third second reactivity is higher than the second reactivity, and the second reactivity is higher than the first reactivity, the hydrocarbon feed is catalytically cracked in a riser reactor, the first light naphtha fraction is injected in a first location of the riser reactor, the second light naphtha fraction is injected in a second location of the riser reactor, the third light naphtha fraction is injected in a third location of the riser reactor, the second location is between the first location and the third location, and the first location is lower than the third location.

A tenth aspect of the present disclosure may include any one of the first through ninth aspects, where: the first light naphtha fraction has a first residence time in the riser reactor, the second light naphtha fraction has a second residence time in the riser reactor, the third light naphtha fraction has a third residence time in the riser reactor, the first residence time is longer than the second residence time, and the second residence time is longer than the third residence time.

An eleventh aspect of the present disclosure may include any one of the first through tenth aspects, where: the plurality of FCC naphtha fractions comprise a first light naphtha fraction having a first reactivity, a second light naphtha fraction having a second reactivity, and a third light naphtha fraction having a third reactivity, the third second reactivity is higher than the second reactivity, and the second reactivity is higher than the first reactivity, the hydrocarbon feed is catalytically cracked in a downer reactor, the first light naphtha fraction is injected in a first location of the downer reactor, the second light naphtha fraction is injected in a second location of the downer reactor, the third light naphtha fraction is injected in a third location of the downer reactor, the second location is between the first location and the third location, and the first location is higher than the third location.

A twelfth aspect of the present disclosure may include any one of the first through eleventh aspects, where: the first light naphtha fraction has a first residence time in the downer reactor, the second light naphtha fraction has a second residence time in the downer reactor, the third light naphtha fraction has a third residence time in the downer reactor, the first residence time is longer than the second residence time, and the second residence time is longer than the third residence time.

A thirteenth aspect of the present disclosure may include any one of the first through twelfth aspects, where the hydrocarbon feed is catalytically cracked in a riser reactor.

A fourteenth aspect of the present disclosure may include any one of the first through thirteenth aspects, where the hydrocarbon feed is catalytically cracked in a downer reactor.

A fifteenth aspect of the present disclosure may include any one of the first through fourteenth aspects, where the hydrocarbon feed comprises a vacuum gas oil, an atmospheric residue, or both.

A sixteenth aspect of the present disclosure may include any one of the first through fifteenth aspects, where a weight ratio of a catalyst in the FCC reactor to an oil is from 1 to 40.

A seventeenth aspect of the present disclosure may include any one of the first through sixteenth aspects, where a weight ratio of a catalyst in the FCC reactor to an oil is from 3 to 6.

An eighteenth aspect of the present disclosure may include any one of the first through seventeenth aspects, where the hydrocarbon feed is catalytically cracked at a temperature of from 500° C. to 800° C.

A nineteenth aspect of the present disclosure may include any one of the first through eighteenth aspects, where the hydrocarbon feed is catalytically cracked at a temperature of from 500° C. to 600° C.

A twentieth aspect of the present disclosure may include any one of the first through nineteenth aspects, where the hydrocarbon feed is catalytically cracked at a residence time in the FCC reactor from 0.1 seconds to 60 seconds.

A twenty-first aspect of the present disclosure may include any one of the first through twentieth aspects, where the hydrocarbon feed is catalytically cracked at a residence time in the FCC reactor from 20 seconds to 60 seconds.

A twenty-second aspect of the present disclosure may include any one of the first through twenty-first aspects, further comprising: sending a spent FCC catalyst to a catalyst regenerator; regenerating the spent FCC catalyst in the catalyst regenerator to produce a regenerated FCC catalyst; and recycling the regenerated FCC catalyst back to the FCC reactor.

A twenty-third aspect of the present disclosure may include any one of the first through twenty-second aspects, comprising separating the cracking effluent in the cracking effluent separation system to produce at least the light olefin product, the plurality of FCC naphtha fractions, a light gas fraction, and a heavy fraction, where the light gas fraction comprises C1-C2 hydrocarbons and the heavy fraction comprises hydrocarbons having greater than 12 carbon atoms.

A twenty-fourth aspect of the present disclosure may include any one of the first through twenty-third aspects, where separating the cracking effluent into at least the light olefin product and the plurality of FCC naphtha fractions comprises: separating the cracking effluent in the cracking effluent separation system to produce the light olefin product, an FCC naphtha stream comprising constituents having from boiling point temperatures between 35° C. and 220° C., a light gas fraction, and a heavy fraction; and subsequently separating the FCC naphtha stream into the plurality of FCC naphtha fractions.

It is noted that any two quantitative values assigned to a property may constitute a range of that property, and all combinations of ranges formed from all stated quantitative values of a given property are contemplated in this disclosure.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Having described the subject matter of the present disclosure in detail and by reference to specific aspects, it is noted that the various details of such aspects should not be taken to imply that these details are essential components of the aspects. Rather, the claims appended hereto should be taken as the sole representative of the breadth of the present disclosure and the corresponding scope of the various aspects described in this disclosure. Further, it will be apparent that modifications and variations are possible without departing from the scope of the appended claims.

What is claimed is:

1. A process for producing light olefins through fluidized catalytic cracking (FCC), the process comprising:

contacting a hydrocarbon feed with an FCC catalyst in an FCC reactor at reaction conditions that cause at least a portion of hydrocarbons from the hydrocarbon feed to undergo catalytic cracking reactions to produce a cracking effluent comprising the light olefins, where the light olefins comprise ethylene, propylene, butenes, or combinations of these, wherein the hydrocarbon feed comprises one or more heavy oils and has at least one of the following:

a boiling point at 50 wt. % of greater than or equal to 350° C., a Final Boiling Point of greater than or equal to 565° C., or an API gravity of from 10 degrees to 50 degrees;

separating the cracking effluent in a cracking effluent separation system to produce a light olefin effluent and a plurality of FCC naphtha fractions, where:

the light olefin effluent comprises propylene, butenes, or combinations thereof, each of the plurality of FCC naphtha fractions has a different boiling point temperature range; and the constituents of all of the plurality of FCC naphtha fractions have a number of carbon atoms between 5 and 12;

recycling at least two of the FCC naphtha fractions back to the FCC reactor; and injecting each of the FCC naphtha fractions at a different location within the FCC reactor based on reactivity of each of the at least two of the plurality of FCC naphtha fractions.

2. The process of claim 1, where:

the FCC reactor comprises a riser reactor, the plurality of FCC naphtha fractions comprise a first light naphtha fraction having a first reactivity and a second light naphtha fraction having a second reactivity, where the second reactivity is higher than the first reactivity, the first light naphtha fraction is injected in a first location of the riser reactor, and the second light naphtha fraction is injected in a second location of the riser reactor, where the second location is located vertically higher than the first location.

3. The process of claim 1, where:

the FCC reactor is a downer reactor, the plurality of FCC naphtha fractions comprise a first light naphtha fraction having a first reactivity and a second light naphtha fraction having a second reactivity, the second reactivity is higher than the first reactivity, the first light naphtha fraction is injected in a first location of the downer reactor, and the second light naphtha fraction is injected in a second location of the riser reactor, where the second location is located vertically lower than the first location.

4. The process of claim 1, where the plurality of FCC naphtha fractions comprise a first light naphtha fraction having a boiling point temperature range of from 20 Celsius (° C.) to 50° C., a second light naphtha fraction having a boiling point temperature range of from 50° C. to 75° C., a third light naphtha fraction having a boiling point temperature range of from 75° C. to 100° C., a middle naphtha fraction having a boiling point temperature range of from 100° C. to 160° C., and a heavy naphtha fraction having a boiling point temperature range of from 160° C. to 220° C.

5. The process of claim 1, where the plurality of FCC naphtha fractions comprise a first light naphtha fraction having a boiling point of from 20° C. to 50° C., a second light naphtha fraction having a boiling point of from 50° C. to 75° C., and a third light naphtha fraction having a boiling point of from 75° C. to 100° C.

6. The process of claim 1, where the plurality of FCC naphtha fractions comprise a first light naphtha fraction having a number of carbon atoms of 5 and 6, a second light naphtha fraction having a number of carbon atoms of 7 and 8, a third light naphtha fraction having a number of carbon atoms of 9 and 10, and a fourth light naphtha fraction having a number of carbon atoms of 11 and 12.

7. The process of claim 1, where the plurality of FCC naphtha fractions comprise an FCC C5 naphtha fraction having a number of carbon atoms of 5, an FCC C6 naphtha fraction having a number of carbon atoms of 6, an FCC C7 naphtha fraction having a number of carbon atoms of 7, an FCC C8 naphtha fraction having a number of carbon atoms of 8, an FCC C9 naphtha fraction having a number of carbon atoms of 9, an FCC C10 naphtha fraction having a number of carbon atoms of 10, an FCC C11 naphtha fraction having a number of carbon atoms of 11, and an FCC C12 naphtha fraction having a number of carbon atoms of 12.

8. The process of claim 1, where:

the plurality of FCC naphtha fractions comprise an FCC C5 naphtha fraction having a number of carbon atoms of 5, an FCC C6 naphtha fraction having a number of carbon atoms of 6, an FCC C7 naphtha fraction having a number of carbon atoms of 7, an FCC C8 naphtha fraction having a number of carbon atoms of 8, an FCC C9 naphtha fraction having a number of carbon atoms of 9, an FCC C10 naphtha fraction having a number of carbon atoms of 10, an FCC C11 naphtha fraction having a number of carbon atoms of 11, and an FCC C12 naphtha fraction having a number of carbon atoms of 12, and the FCC C5 naphtha fraction, the FCC C6 naphtha fraction, and the FCC C7 naphtha fraction are recycled back to the FCC reactor.

9. The process of claim 1, where:

the plurality of FCC naphtha fractions comprise a first light naphtha fraction having a first reactivity, a second light naphtha fraction having a second reactivity, and a third light naphtha fraction having a third reactivity, the third second reactivity is higher than the second reactivity, and the second reactivity is higher than the first reactivity, the hydrocarbon feed is catalytically cracked in a riser reactor, the first light naphtha fraction is injected in a first location of the riser reactor, the second light naphtha fraction is injected in a second location of the riser reactor, the third light naphtha fraction is injected in a third location of the riser reactor, the second location is between the first location and the third location, and the first location is lower than the third location.

10. The process of claim 9, where:

the first light naphtha fraction has a first residence time in the riser reactor, the second light naphtha fraction has a second residence time in the riser reactor, the third light naphtha fraction has a third residence time in the riser reactor, the first residence time is longer than the second residence time, and the second residence time is longer than the third residence time.

11. The process of claim 1, where:

the plurality of FCC naphtha fractions comprise a first light naphtha fraction having a first reactivity, a second light naphtha fraction having a second reactivity, and a third light naphtha fraction having a third reactivity, the third second reactivity is higher than the second reactivity, and the second reactivity is higher than the first reactivity, the hydrocarbon feed is catalytically cracked in a downer reactor, the first light naphtha fraction is injected in a first location of the downer reactor, the second light naphtha fraction is injected in a second location of the downer reactor, the third light naphtha fraction is injected in a third location of the downer reactor, the second location is between the first location and the third location, and the first location is higher than the third location.

12. The process of claim 10, where:

the first light naphtha fraction has a first residence time in the downer reactor, the second light naphtha fraction has a second residence time in the downer reactor, the third light naphtha fraction has a third residence time in the downer reactor, the first residence time is longer than the second residence time, and the second residence time is longer than the third residence time.

13. The process of claim 1, where the hydrocarbon feed is catalytically cracked in a riser reactor or a downer reactor.

14. The process of claim 1, where the hydrocarbon feed comprises a vacuum gas oil having a boiling point of from 350° C. to 565° C., an atmospheric residue having a boiling point of greater than or equal to 350° C., or both.

15. The process of claim 1, where a weight ratio of a catalyst in the FCC reactor to an oil is from 1 to 40.

16. The process of claim 1, where the hydrocarbon feed is catalytically cracked at a temperature of from 500° C. to 800° C.

17. The process of claim 1, where the hydrocarbon feed is catalytically cracked at a residence time in the FCC reactor from 0.1 seconds to 60 seconds.

18. The process of claim 1, further comprising:

sending a spent FCC catalyst to a catalyst regenerator;

regenerating the spent FCC catalyst in the catalyst regenerator to produce a regenerated FCC catalyst; and recycling the regenerated FCC catalyst back to the FCC reactor.

19. The process of claim 1, comprising separating the cracking effluent in the cracking effluent separation system to produce at least the light olefin product, the plurality of FCC naphtha fractions, a light gas fraction, and a heavy fraction, where the light gas fraction comprises C1-C2 hydrocarbons and the heavy fraction comprises hydrocarbons having greater than 12 carbon atoms.

20. The process of claim 1, where separating the cracking effluent into at least the light olefin product and the plurality of FCC naphtha fractions comprises:

separating the cracking effluent in the cracking effluent separation system to produce the light olefin product, an FCC naphtha stream comprising constituents having from boiling point temperatures between 35° C. and 220° C., a light gas fraction, and a heavy fraction; and subsequently separating the FCC naphtha stream into the plurality of FCC naphtha fractions.

* * * * *